US011518133B2

(12) United States Patent
Walsh

(10) Patent No.: US 11,518,133 B2
(45) Date of Patent: Dec. 6, 2022

(54) METHOD AND SYSTEM FOR FORMING PACKAGES

(71) Applicant: Graphic Packaging International, LLC, Atlanta, GA (US)

(72) Inventor: Joseph C. Walsh, Boulder, CO (US)

(73) Assignee: Graphic Packaging International, LLC, Atlanta, GA (US)

( * ) Notice: Subject to any disclaimer, the term of this patent is extended or adjusted under 35 U.S.C. 154(b) by 257 days.

(21) Appl. No.: 16/832,106

(22) Filed: Mar. 27, 2020

(65) Prior Publication Data

US 2020/0223611 A1 Jul. 16, 2020

Related U.S. Application Data

(62) Division of application No. 15/142,435, filed on Apr. 29, 2016, now Pat. No. 10,640,271.
(Continued)

(51) Int. Cl.
*B65D 75/52* (2006.01)
*A47G 21/00* (2006.01)
(Continued)

(52) U.S. Cl.
CPC ..... *B31B 70/8131* (2017.08); *A47G 21/00* (2013.01); *B31B 70/008* (2017.08);
(Continued)

(58) Field of Classification Search
CPC ..... B31B 70/262; B31B 70/008; B31B 2155/0014; B65D 65/14; B65D 65/22; B65D 75/525; A47G 21/00
See application file for complete search history.

(56) References Cited

U.S. PATENT DOCUMENTS 1,474,088 A 11/1923 Reynolds
1,516,090 A 11/1924 Gary et al.
(Continued)

FOREIGN PATENT DOCUMENTS

CA 2 384 311 3/2001
CA 2 586 472 5/2006
(Continued)

OTHER PUBLICATIONS

International Search Report and Written Opinion for PCT/US2016/029989 dated Aug. 16, 2016.
(Continued)

*Primary Examiner* — Nathaniel C Chukwurah
*Assistant Examiner* — Lucas E. A. Palmer
(74) *Attorney, Agent, or Firm* — Womble Bond Dickinson (US) LLP

(57) ABSTRACT

A system and method for forming reinforced packages. The method can comprise forming an attached web by adhering a construct to a web of material, and moving the attached web in a downstream direction through at least a web edge forming assembly. The moving the attached web can comprise moving the construct with the web of material. The method further can include at least partially forming a folded web by folding at least a portion of the web of material as the attached web moves through the web folding assembly and forming a reinforced package comprising a liner and the construct by separating the liner from a remainder of the folded web. The construct is adhered to the liner.

13 Claims, 21 Drawing Sheets

Related U.S. Application Data

(60) Provisional application No. 62/179,480, filed on May 8, 2015, provisional application No. 62/179,172, filed on Apr. 29, 2015.

(51) Int. Cl.

| | |
|---|---|
| ***B65D 65/14*** | (2006.01) |
| ***B65D 65/22*** | (2006.01) |
| ***B31B 70/00*** | (2017.01) |
| ***B31B 70/26*** | (2017.01) |
| ***B31B 70/81*** | (2017.01) |
| *B31B 155/00* | (2017.01) |

(52) U.S. Cl.

CPC ..... *B31B 70/262* (2017.08); *B65D 65/14* (2013.01); *B65D 65/22* (2013.01); *B65D 75/525* (2013.01); *A47G 21/001* (2013.01); *B31B 2155/0014* (2017.08)

(56) References Cited

U.S. PATENT DOCUMENTS 1,664,111 A 3/1928 Johnson
2,092,858 A 9/1937 Richard
2,095,910 A 10/1937 Bergstein
2,099,257 A * 11/1937 Bergstein ..... B65D 5/4204 229/162.1
2,107,946 A 2/1938 Inman
2,114,625 A 4/1938 Bergstein
2,134,057 A 10/1938 Potdevin
2,132,966 A 11/1938 O'Brien
2,166,388 A 7/1939 Bergstein
2,197,113 A 4/1940 Piazze
2,250,249 A 7/1941 Bergstein
2,273,470 A 2/1942 Gardner
2,282,207 A 5/1942 Palmer
2,286,465 A 6/1942 Erlin
RE23,096 E 4/1949 Mullinix
2,502,117 A * 3/1950 Anderson ..... B31B 50/73 493/110
2,553,923 A 5/1951 Lambert
2,758,520 A 8/1956 Hepworth
2,799,211 A * 7/1957 Zerlin ..... B31B 50/81 493/60
2,835,435 A 5/1958 Mullinix
2,870,023 A 1/1959 Vogt
2,913,161 A 11/1959 Travis
2,987,402 A 6/1961 Dold
3,104,596 A * 9/1963 Bergstein ..... B29D 23/001 493/90
3,105,417 A 10/1963 Hammer
3,142,231 A 7/1964 Christensson
3,142,430 A 7/1964 Meyers
3,153,991 A * 10/1964 Goodrich ..... B31F 1/10 493/274
3,194,471 A 7/1965 Murphy
3,218,961 A 11/1965 Kraft et al.
3,240,419 A 3/1966 Spiering et al.
3,249,286 A 5/1966 Palmer
3,250,454 A 5/1966 Steiger
3,272,423 A 9/1966 Bjarno
3,324,998 A 6/1967 Farquhar
3,336,846 A 8/1967 Berghgracht
3,357,631 A 12/1967 Aid et al.
3,395,623 A 8/1968 Baker
3,399,818 A 9/1968 Stegner
3,412,925 A 11/1968 Booth
3,428,235 A 2/1969 Randazzo
3,459,357 A 8/1969 Egger et al.
3,461,642 A 8/1969 Langen et al.
3,482,758 A 12/1969 Pierre
3,515,333 A 6/1970 Kotkas et al.
3,543,469 A 12/1970 Ullman
3,552,640 A * 1/1971 Young ..... B65D 27/00 229/928
3,554,434 A 1/1971 Anderson
3,570,751 A * 3/1971 Trewella ..... B65D 75/5827 383/207
3,575,409 A 4/1971 Calvert
3,576,290 A 4/1971 Marchisen
3,616,027 A 10/1971 Honsel
3,627,541 A 12/1971 Farquhar
3,637,130 A 1/1972 Farquhar
3,659,777 A 5/1972 Kanada et al.
3,739,545 A 6/1973 Lattke
3,800,677 A 4/1974 Jones et al.
3,878,771 A * 4/1975 Malcolm ..... B65D 5/4608 156/251
RE28,554 E 9/1975 Curler et al.
3,945,870 A * 3/1976 Johnsen ..... B32B 7/12 156/289
3,959,950 A 6/1976 Fukuda
3,964,669 A 6/1976 Sontag et al.
3,981,494 A 9/1976 Prestegaard
4,011,983 A 3/1977 Greene
4,034,658 A 7/1977 Sherman
4,082,216 A 4/1978 Clarke
4,164,171 A 8/1979 Meyers et al.
4,170,928 A 10/1979 Beasley
4,196,035 A 4/1980 Reil
4,228,945 A 10/1980 Wysocki
4,244,281 A 1/1981 Kauffman et al.
4,267,955 A 5/1981 Strubble
4,284,205 A 8/1981 Hirata
4,312,451 A 1/1982 Forbes, Jr.
4,313,542 A 2/1982 Roberts et al.
4,331,434 A 5/1982 Buschor
4,398,636 A 8/1983 Baxter
4,413,464 A 11/1983 Larsson et al.
4,457,483 A 7/1984 Gagne
4,477,014 A 10/1984 Brandenburger
4,478,351 A 10/1984 Homma
4,484,683 A 11/1984 Werner, Jr.
4,490,960 A 1/1985 Klemesrud
4,494,785 A 1/1985 Song
4,520,615 A 6/1985 Engler
4,575,000 A 3/1986 Gordon et al.
4,577,746 A 3/1986 Tokuno et al.
4,578,929 A 4/1986 Tisma
4,582,315 A * 4/1986 Scarpa ..... B65B 43/145 271/166
4,600,346 A * 7/1986 Podosek ..... B42C 7/00 493/110
4,605,464 A 8/1986 Slevin
4,608,259 A 8/1986 Cortopassi
4,627,223 A 12/1986 Janhonen
4,726,170 A 2/1988 Sawa et al.
4,747,703 A 5/1988 Gazes
4,754,914 A 7/1988 Wischusen, III
4,775,771 A 10/1988 Pawlowski
4,785,696 A 11/1988 Martiny
4,793,117 A 12/1988 Raudat et al.
4,802,664 A 2/1989 Larsen
4,854,983 A 8/1989 Bryniarski
4,865,921 A 9/1989 Hollenberg
4,881,934 A 11/1989 Harston et al.
4,890,439 A 1/1990 Smart
4,919,785 A 4/1990 Willey et al.
4,930,639 A 6/1990 Rigby
4,936,935 A 6/1990 Beckett
4,940,200 A 7/1990 Sawyer
4,963,424 A 10/1990 Beckett
4,986,522 A 1/1991 Paulson
4,995,217 A 2/1991 Francis, Jr.
5,014,582 A 5/1991 Teik
5,019,029 A 5/1991 Calvert
5,028,147 A 7/1991 Graham
5,034,234 A 7/1991 Andreas et al.
5,071,062 A 12/1991 Bradley et al.
5,078,273 A 1/1992 Kuchenbecker
5,080,643 A 1/1992 Mitchell et al.
5,093,364 A 3/1992 Richards

(56) References Cited

U.S. PATENT DOCUMENTS 5,096,723 A 3/1992 Turpin
5,097,651 A 3/1992 Decottignies et al.
5,102,385 A 4/1992 Calvert
5,102,485 A 4/1992 Keeler et al.
5,108,355 A * 4/1992 Walsh ..... B31B 50/81 493/110
5,117,078 A 5/1992 Beckett
5,132,124 A 7/1992 Tamaki et al.
5,154,041 A 10/1992 Schneider
5,175,404 A 12/1992 Andreas et al.
5,176,612 A 1/1993 Calvert et al.
5,199,792 A 4/1993 Roosa
5,205,651 A 4/1993 Decottignies et al.
5,207,629 A 5/1993 Walsh
5,213,902 A 5/1993 Beckett
5,221,419 A 6/1993 Beckett
5,224,919 A 7/1993 Walsh
5,242,365 A 9/1993 Counts
5,254,071 A 10/1993 Laroche
5,260,537 A 11/1993 Beckett
5,266,386 A 11/1993 Beckett
5,282,349 A 2/1994 Siegel
5,282,528 A 2/1994 Hudson
5,326,022 A 7/1994 Green
5,330,099 A 7/1994 Beales et al.
RE34,683 E 8/1994 Maynard
5,337,951 A 8/1994 Roccaforte
5,340,436 A 8/1994 Beckett
5,346,311 A 9/1994 Siler et al.
5,354,973 A 10/1994 Beckett
5,410,135 A 4/1995 Pollart
5,411,165 A 5/1995 Ellis
5,424,517 A 6/1995 Habeger
5,427,267 A 6/1995 Willman
5,484,100 A 1/1996 Rigby
5,492,269 A 2/1996 Sung
5,510,132 A 4/1996 Gallo, Jr.
5,519,195 A 5/1996 Keefer
5,585,027 A 12/1996 Young
5,615,795 A 4/1997 Tipps
5,628,921 A 5/1997 Beckett
5,632,368 A 5/1997 Moncrief
5,653,671 A 8/1997 Reuteler
5,657,610 A 8/1997 Dietrich et al.
5,662,577 A 9/1997 Reuteler
5,672,407 A 9/1997 Beckett
5,688,427 A 11/1997 Gallo, Jr.
5,733,236 A 3/1998 De Smedt
5,746,871 A 5/1998 Walsh
5,759,422 A 6/1998 Schmelzer
5,772,569 A * 6/1998 Janhonen ..... B65D 75/38 493/93
5,800,724 A 9/1998 Habeger
5,845,769 A 12/1998 Yeager
5,876,319 A 3/1999 Holton
5,921,681 A 7/1999 Money
5,938,110 A 8/1999 Bernstein
5,944,183 A 8/1999 Rowland et al.
5,964,161 A 10/1999 Conway
5,997,458 A 12/1999 Guttinger et al.
6,050,063 A 4/2000 Ford et al.
6,063,415 A 5/2000 Walters
6,073,423 A 6/2000 House
6,082,613 A 7/2000 Mikulski et al.
6,114,679 A 9/2000 Lai
6,132,351 A 10/2000 Lotto et al.
6,139,662 A 10/2000 Forman
6,146,028 A 11/2000 Preszler
6,150,646 A 11/2000 Lai et al.
6,204,492 B1 3/2001 Zeng et al.
6,206,279 B1 3/2001 Countee
6,213,286 B1 4/2001 Hunter et al.
6,234,384 B1 5/2001 Capy et al.
6,251,451 B1 6/2001 Zeng
6,254,519 B1 7/2001 Toshima
6,311,457 B1 11/2001 May et al.
6,312,742 B1 11/2001 Wood et al.
6,319,182 B1 11/2001 Schneider
6,332,488 B1 * 12/2001 Walsh ..... B32B 37/1292 229/800
6,335,042 B1 1/2002 Money
6,349,874 B1 2/2002 Hill
6,360,941 B1 3/2002 Larsson
6,398,010 B1 6/2002 Fangmeier
6,401,927 B1 6/2002 Sorensen et al.
6,414,290 B1 7/2002 Cole
6,425,847 B1 7/2002 Broenstrup
6,431,365 B1 8/2002 Money
6,433,322 B2 8/2002 Zeng et al.
6,455,827 B2 9/2002 Zeng
6,490,843 B1 12/2002 May
6,494,619 B1 12/2002 Sulpizio
6,509,052 B1 1/2003 Benham et al.
6,550,608 B1 4/2003 Brown et al.
6,552,315 B2 4/2003 Zeng et al.
6,635,139 B2 10/2003 Bohn
6,637,646 B1 * 10/2003 Muise ..... B65D 5/606 229/117.27
6,657,165 B1 12/2003 Makutonin
6,676,583 B2 1/2004 Walsh
6,677,563 B2 1/2004 Lai
6,683,289 B2 1/2004 Whitmore et al.
6,695,202 B2 2/2004 Miess
6,702,178 B2 3/2004 Bowers et al.
6,717,121 B2 4/2004 Zeng
6,744,028 B2 6/2004 Chisholm et al.
6,765,182 B2 7/2004 Cole
6,854,639 B2 2/2005 Walsh
6,869,387 B2 3/2005 Post et al.
6,915,829 B2 7/2005 Popp
6,948,293 B1 9/2005 Eckermann
6,986,920 B2 1/2006 Forman et al.
6,993,889 B2 2/2006 Ford et al.
7,019,271 B2 3/2006 Wnek et al.
7,070,551 B2 7/2006 Lasson
7,143,930 B2 12/2006 Money et al.
7,414,230 B2 8/2008 Fitzwater
7,445,590 B2 11/2008 Selle et al.
7,461,838 B2 12/2008 Hendricks et al.
7,473,875 B2 1/2009 Fitzwater
7,509,789 B2 3/2009 Scholtes et al.
7,510,515 B2 3/2009 Ichikawa
7,604,155 B2 10/2009 Bossel et al.
7,667,167 B2 2/2010 Fitzwater
7,695,421 B2 4/2010 Ford
7,699,214 B2 4/2010 Mestre et al.
7,794,147 B2 9/2010 Perelman
7,819,583 B2 10/2010 Walker et al.
7,837,606 B2 11/2010 Tetenborg et al.
7,893,389 B2 2/2011 Fitzwater
7,913,897 B2 3/2011 Manaige
7,935,041 B2 5/2011 Graham et al.
7,938,312 B2 5/2011 Ford
7,959,060 B2 6/2011 Wilson et al.
7,982,167 B2 7/2011 Fitzwater
7,984,844 B2 7/2011 Jones
8,013,280 B2 9/2011 Robison et al.
8,024,910 B2 9/2011 Graham et al.
8,025,618 B2 9/2011 Walsh et al.
8,066,137 B2 11/2011 Sanfilippo et al.
8,142,077 B2 3/2012 Iannelli, II et al.
8,196,805 B2 6/2012 Brand et al.
8,206,033 B2 6/2012 Sato et al.
8,226,794 B2 7/2012 Fogle
8,309,896 B2 11/2012 Fitzwater
8,317,671 B1 11/2012 Zoeckler
8,323,165 B2 12/2012 Atoui
8,403,819 B2 3/2013 Zoeckler
8,403,820 B2 3/2013 Zoeckler
8,468,782 B2 6/2013 Michalsky et al.
8,474,163 B2 7/2013 Rubin
8,479,972 B2 7/2013 Craft
8,500,330 B2 8/2013 Nomura et al.
8,579,780 B2 11/2013 Senbo

(56) References Cited

U.S. PATENT DOCUMENTS

| | | | | |
|---|---|---|---|---|
| 8,672,214 | B2 | 3/2014 | Manaige | |
| 8,727,204 | B2 | 5/2014 | Burke | |
| 8,826,959 | B2 | 9/2014 | Files et al. | |
| 8,870,519 | B2 | 10/2014 | Karst | |
| 8,961,380 | B2 | 2/2015 | Langen | |
| 9,050,770 | B1 * | 6/2015 | Russell | B31B 70/60 |
| 9,073,659 | B2 | 7/2015 | Smith | |
| 9,108,761 | B2 | 8/2015 | Fitzwater et al. | |
| 9,113,648 | B2 | 8/2015 | Burke | |
| 9,156,579 | B2 | 10/2015 | Pinkstone | |
| 9,156,582 | B2 | 10/2015 | Walsh et al. | |
| 9,238,343 | B2 | 1/2016 | Selle et al. | |
| 9,346,234 | B2 | 5/2016 | Hajek et al. | |
| 9,346,582 | B2 | 5/2016 | Pinkstone | |
| 9,463,896 | B2 | 10/2016 | Fitzwater | |
| 9,522,499 | B2 | 12/2016 | Files et al. | |
| 9,663,320 | B2 | 5/2017 | Wittmann et al. | |
| 9,758,275 | B2 | 9/2017 | Fitzwater et al. | |
| 10,023,349 | B2 | 7/2018 | Fitzwater | |
| 10,173,805 | B2 | 1/2019 | Waddington | |
| 10,640,271 | B2 | 5/2020 | Walsh | |
| 10,737,824 | B2 | 8/2020 | Fitzwater | |
| 2002/0041067 | A1 | 4/2002 | Muller | |
| 2002/0148882 | A1 | 10/2002 | Bowers | |
| 2003/0002755 | A1 | 1/2003 | Kim et al. | |
| 2003/0080120 | A1 | 5/2003 | Whitmore et al. | |
| 2003/0144121 | A1 | 7/2003 | Walsh | |
| 2003/0185948 | A1 | 10/2003 | Garwood | |
| 2003/0197051 | A1 * | 10/2003 | Muise | B65D 5/606 229/117.27 |
| 2003/0206997 | A1 | 11/2003 | Winkelman et al. | |
| 2004/0004111 | A1 | 1/2004 | Cardinale | |
| 2004/0016216 | A1 | 1/2004 | Romagnoli | |
| 2004/0074947 | A1 | 4/2004 | Hillebrand | |
| 2004/0101605 | A1 | 5/2004 | Sigel | |
| 2004/0206049 | A1 | 10/2004 | Hiramoto et al. | |
| 2005/0014623 | A1 | 1/2005 | Van De Kruys | |
| 2005/0124478 | A1 | 6/2005 | Scholtes et al. | |
| 2005/0272583 | A1 | 12/2005 | Totani | |
| 2005/0284865 | A1 | 12/2005 | Fogle et al. | |
| 2006/0009339 | A1 | 1/2006 | Sleight et al. | |
| 2006/0027303 | A1 | 2/2006 | Hunter | |
| 2006/0037290 | A1 | 2/2006 | Smith | |
| 2006/0049190 | A1 | 3/2006 | Middleton | |
| 2006/0096978 | A1 | 5/2006 | Lafferty et al. | |
| 2006/0113300 | A1 | 6/2006 | Wnek et al. | |
| 2006/0191929 | A1 | 8/2006 | Berg, Jr. et al. | |
| 2007/0131742 | A1 | 6/2007 | Fitzwater | |
| 2007/0131743 | A1 | 6/2007 | Fitzwater | |
| 2007/0131744 | A1 | 6/2007 | Fitzwater | |
| 2007/0131745 | A1 | 6/2007 | Fitzwater | |
| 2007/0137222 | A1 | 6/2007 | Kastanek et al. | |
| 2007/0138247 | A1 | 6/2007 | Fitzwater | |
| 2007/0151888 | A1 | 7/2007 | Bossel et al. | |
| 2007/0267466 | A1 | 11/2007 | Brand et al. | |
| 2008/0067225 | A1 | 3/2008 | Moore | |
| 2008/0227612 | A1 | 9/2008 | Harston | |
| 2008/0308614 | A1 | 12/2008 | Fitzwater | |
| 2009/0005228 | A1 | 1/2009 | Goto | |
| 2009/0039077 | A1 | 2/2009 | Fitzwater | |
| 2009/0139187 | A1 | 6/2009 | Wood | |
| 2009/0193757 | A1 | 8/2009 | Roesler | |
| 2009/0197750 | A1 | 8/2009 | Beckmann | |
| 2009/0214142 | A1 | 8/2009 | Bossel et al. | |
| 2009/0252440 | A1 | 10/2009 | Biese | |
| 2010/0022375 | A1 | 1/2010 | Colla | |
| 2010/0046861 | A1 | 2/2010 | Wilcoxen | |
| 2010/0066007 | A1 | 3/2010 | Muller | |
| 2010/0263332 | A1 | 10/2010 | Files et al. | |
| 2010/0284634 | A1 | 11/2010 | Hadley | |
| 2011/0017812 | A1 | 1/2011 | Belko et al. | |
| 2011/0019942 | A1 | 1/2011 | Piraneo | |
| 2011/0052106 | A1 | 3/2011 | Holmes et al. | |
| 2011/0053746 | A1 | 3/2011 | Desertot et al. | |
| 2011/0255809 | A1 | 10/2011 | Tucker et al. | |
| 2011/0297680 | A1 | 12/2011 | Howell et al. | |
| 2012/0224794 | A1 | 9/2012 | Veder | |
| 2012/0231941 | A1 * | 9/2012 | Senbo | B31B 50/00 493/189 |
| 2012/0267425 | A1 | 10/2012 | Whiteside | |
| 2012/0297736 | A1 * | 11/2012 | Ausnit | B65D 5/20 493/393 |
| 2013/0068653 | A1 | 3/2013 | Lipinski | |
| 2013/0202229 | A1 | 8/2013 | Broering | |
| 2014/0016882 | A1 | 1/2014 | Fitzwater | |
| 2014/0045666 | A1 | 2/2014 | Endou et al. | |
| 2014/0113787 | A1 | 4/2014 | Aganovic et al. | |
| 2014/0128235 | A1 * | 5/2014 | Walsh, Jr. | B31B 70/16 493/264 |
| 2014/0270592 | A1 * | 9/2014 | Walsh | B65D 33/007 383/105 |
| 2015/0048152 | A1 | 2/2015 | Vistrom | |
| 2015/0072848 | A1 | 3/2015 | Graham et al. | |
| 2015/0083789 | A1 | 3/2015 | Fitzwater et al. | |
| 2015/0367974 | A1 | 12/2015 | Sytema | |
| 2016/0107814 | A1 | 4/2016 | Fitzwater | |
| 2016/0159516 | A1 | 6/2016 | Ball | |
| 2016/0185065 | A1 | 6/2016 | Sytema | |
| 2016/0318274 | A1 * | 11/2016 | Walsh | B29C 66/8511 |
| 2016/0318275 | A1 * | 11/2016 | Walsh | A47G 21/00 |
| 2016/0368205 | A1 | 12/2016 | Wieduwilt et al. | |
| 2017/0015079 | A1 | 1/2017 | Walsh | |
| 2018/0086018 | A1 | 3/2018 | Fukuda | |
| 2018/0339480 | A1 | 11/2018 | Yanagisawa | |
| 2019/0143625 | A1 | 5/2019 | Lau | |

FOREIGN PATENT DOCUMENTS

| | | | |
|---|---|---|---|
| CN | 101102887 | A | 1/2008 |
| CN | 103434294 | A | 12/2013 |
| DE | 1 060 313 | | 6/1959 |
| DE | 11 47 379 | B | 4/1963 |
| DE | 18 10 965 | A1 | 10/1970 |
| DE | 203 00 817 | | 4/2003 |
| EP | 0 729 828 | A2 | 9/1996 |
| EP | 1 072 526 | | 1/2001 |
| EP | 1 424 290 | A2 | 6/2004 |
| EP | 1 452 458 | | 9/2004 |
| EP | 1 457 425 | | 9/2004 |
| EP | 1 353 843 | B1 | 4/2005 |
| EP | 1 798 159 | A1 | 6/2007 |
| EP | 1 964 785 | | 9/2008 |
| EP | 2 487 027 | | 8/2012 |
| EP | 2 492 203 | | 8/2012 |
| EP | 2 492 204 | | 8/2012 |
| EP | 2 716 438 | A1 | 4/2014 |
| EP | 2 748 078 | B1 | 10/2016 |
| EP | 2 505 347 | B1 | 12/2016 |
| FR | 1 048 714 | A | 12/1953 |
| FR | 2 516 481 | | 5/1983 |
| FR | 2 665 882 | | 2/1992 |
| FR | 2 687 384 | | 8/1993 |
| GB | 632554 | | 11/1949 |
| GB | 833 296 | A | 4/1960 |
| GB | 2 293 569 | A | 4/1996 |
| GB | 2 351 035 | A | 12/2000 |
| GB | 2 365 000 | | 2/2002 |
| JP | S61-232175 | | 10/1986 |
| JP | 62-16319 | | 1/1987 |
| JP | S63-502418 | | 9/1988 |
| JP | 5-28626 | | 4/1993 |
| JP | 5-147664 | | 6/1993 |
| JP | 2004 224402 | | 8/2004 |
| JP | 2005-320022 | A | 11/2005 |
| JP | 2006-240671 | A | 9/2006 |
| JP | 2008-105707 | A | 5/2008 |
| JP | 2011-168330 | | 9/2011 |
| JP | 2011-168331 | | 9/2011 |
| JP | 2011-173640 | | 9/2011 |
| JP | 2011-189978 | A | 9/2011 |
| JP | 2010-222050 | | 10/2011 |
| JP | 2011-251774 | A | 12/2011 |
| JP | 2012-51579 | | 3/2012 |

(56) References Cited

FOREIGN PATENT DOCUMENTS

| | | | |
|---|---|---|---|
| JP | 2012-152901 | | 8/2012 |
| JP | 2012-187899 | | 10/2012 |
| JP | 2012-533487 | | 12/2012 |
| JP | 2018-039167 | | 3/2018 |
| NL | 87 840 | C | 11/1957 |
| WO | WO 87/03249 | | 6/1987 |
| WO | WO 2006/052326 | | 5/2006 |
| WO | WO 2007/067705 | | 6/2007 |
| WO | WO 2007/084525 | A2 | 7/2007 |
| WO | WO 2008/086277 | | 7/2008 |
| WO | WO 2009/023286 | | 2/2009 |
| WO | WO 2011/011283 | A2 | 1/2011 |
| WO | WO 2011/031545 | A2 | 3/2011 |
| WO | WO 2011/040994 | A1 | 4/2011 |
| WO | WO 2013/003149 | A | 1/2013 |
| WO | WO 2013/117983 | A2 | 8/2013 |
| WO | WO 2014/070232 | A1 | 5/2014 |
| WO | WO 2015/028825 | A1 | 3/2015 |
| WO | WO 2015/036674 | A1 | 3/2015 |
| WO | WO 2016/176540 | A1 | 11/2016 |

OTHER PUBLICATIONS

International Search Report and Written Opinion for PCT/US2016/030046 dated Aug. 19, 2016.
Office Action for Canadian Application No. 2,980,354 dated Oct. 1, 2018.
International Search Report and Written Opinion for PCT/US2016/042010 dated Oct. 12, 2016.
International Search Report and Written Opinion for PCT/US2016/047521 dated Dec. 13, 2016.
Supplementary Partial European Search Report for EP 14 84 9557 dated Mar. 7, 2017.
International Search Report and Written Opinion for PCT/US2016/043520 dated Oct. 28, 2016.
International Search Report and Written Opinion for PCT/US2014/057385 dated Jan. 30, 2015.
Office Action for Chinese Application No. 201680024662.X dated Nov. 1, 2018, with English translation.
Notification of Reasons for Refusal for Japanese Application No. 2018-501343 dated Oct. 28, 2019, with English translation.
International Search Report and Written Opinion for PCT/US2019/040772 dated Oct. 24, 2019.
Supplementary European Search Report for EP 16 82 5077 dated Mar. 4, 2019.
Supplementary European Search Report for EP 16 78 7218 dated Jan. 28, 2019.
Notification of the First Office Action for Chinese Application No. 201680041116.7 dated Jan. 4, 2019, with English translation.
Supplementary European Search Report for EP 16 78 7209 dated Dec. 17, 2018.
Supplementary European Search Report for EP 14 84 9557 dated Jun. 7, 2017.
Office Action for U.S. Appl. No. 15/142,435 dated Aug. 10, 2018.
Response to Restriction Requirement for U.S. Appl. No. 15/142,435 dated Aug. 29, 2018.
Office Action for U.S. Appl. No. 15/142,435 dated Oct. 9, 2018.
Amendment A and Response to Office Action for U.S. Appl. No. 15/142,435 dated.
Office Action for U.S. Appl. No. 15/142,435 dated Mar. 5, 2019.
Request for Continued Examination (RCE) Transmittal for U.S. Appl. No. 15/142,435 dated May 24, 2019.
Amendment B and Response to Final Office Action for U.S. Appl. No. 15/142,435 dated May 24, 2019.
Office Action for U.S. Appl. No. 15/142,435 dated Jun. 24, 2019.
Amendment C and Response to Office Action for U.S. Appl. No. 15/142,435 dated Sep. 24, 2019.
Notice of Allowance and Fee(s) Due for U.S. Appl. No. 15/142,435 dated Apr. 10, 2020.
Issue Fee Transmittal Form for U.S. Appl. No. 15/142,435 dated Mar. 27, 2020.
Issue Notification for U.S. Appl. No. 15/142,435 dated Apr. 15, 2020.
Notice of Reasons for Refusal for Japanese Application No. 2018-501343 dated Jul. 6, 2020, with English translation.
Supplementary Partial European Search Report for EP 19 83 3654 dated Mar. 10, 2022.
Supplementary European Search Report for EP 19 83 3654 dated Jul. 4, 2022.

* cited by examiner

METHOD AND SYSTEM FOR FORMING PACKAGES

CROSS-REFERENCED TO RELATED APPLICATIONS

This application is a division of U.S. application Ser. No. 15/142,435, filed on Apr. 29, 2016, which claims the benefit of U.S. Provisional Patent Application No. 62/179,172, filed on Apr. 29, 2015, and U.S. Provisional Patent Application No. 62/179,480, filed on May 8, 2015.

INCORPORATION BY REFERENCE

The disclosures of U.S. patent application Ser. No. 15/142,435, filed Apr. 29, 2016, U.S. Provisional Patent Application No. 62/122,453, filed Oct. 21, 2014, U.S. Provisional Patent Application No. 62/179,172, filed Apr. 29, 2015, U.S. Provisional Patent Application No. 62/179,480, filed on May 8, 2015, U.S. patent application Ser. No. 14/919,072, filed Oct. 21, 2015, and U.S. patent application Ser. No. 15/142,103, filed Apr. 29, 2016, are hereby incorporated by reference for all purposes as if presented herein in their entirety.

BACKGROUND OF THE DISCLOSURE

The present disclosure generally relates to reinforced packages for holding products and to methods of forming the packages. More specifically, the present disclosure is directed to methods and systems for forming the packages including a liner having a gusseted bottom portion and a reinforcing construct attached to the liner.

Bags or liners, such as paper or plastic bags, traditionally have been used for the packaging and transport of products from bulk materials such as rice or sand to larger items. Bags or liners generally are inexpensive and easy to manufacture and can be formed in different configurations and sizes, and can be used for storage and transport of a wide variety of products. In particular, in the Fast Food industry, bags or liners are frequently used for packaging of prepared food items, such as sandwiches, etc. Currently, there is a growing demand for bags or liners or similar packages for use in packaging various products, including sandwiches, French fries, and other prepared food items, for presentation to consumers. However, it is equally important that the costs of such packages necessarily must be minimized as much as possible. While various packages designs including reinforcing or supporting materials have been developed, often, the manufacture of such specialty bags or liners having reinforcing layers or materials supplied thereto has required multiple stages or operations, which can significantly increase the cost of manufacture of such packages.

SUMMARY OF THE DISCLOSURE

In general, one aspect of the disclosure is directed to a method of forming reinforced packages. The method can comprise forming an attached web by adhering a construct to a web of material, and moving the attached web in a downstream direction through at least a web edge forming assembly. The moving the attached web can comprise moving the construct with the web of material. The method further can include at least partially forming a folded web by folding at least a portion of the web of material as the attached web moves through the web folding assembly and forming a reinforced package comprising a liner and the construct by separating the liner from a remainder of the folded web. The construct can be adhered to the liner.

In another aspect, the disclosure is generally directed to a system for forming reinforced packages. The system can comprise an attachment assembly receiving a web of material and a construct. The attachment assembly can bring the construct into engagement with the web of material for forming an attached web. A web edge forming assembly can be disposed downstream from the attachment assembly. The web edge forming assembly can receive the attached web and can comprise web folding features for folding at least a portion of the web of material to at least partially form a folded web. A cutting assembly can comprise cutting features for separating a liner from a remainder of the folded web to at least partially form a reinforced package comprising the liner attached to the construct.

Additional aspects, features, and advantages of the present invention will become apparent from the following description and accompanying figures.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to a system and method of forming reinforced packages for holding products such as food products or other articles. Packages according to the present disclosure can accommodate articles of any shape. The packages can comprise a bag, liner, or wrap material comprising a relatively flexible material attached to a reinforcing construct comprising a relatively rigid material (e.g., paperboard). The bags or liners can generally be made from a paper, plastic or other stock material and can be attached to the reinforcing construct. In one embodiment, the liners comprise polyethylene material or any other suitable heat-sealable material. The reinforcing construct can be of varying widths and can extend about or beyond ends of the liner, and will provide support for the liners upon loading with a product or article or series of articles therein. In some embodiments, the reinforcing construct can be folded with their liners around the food product or article contained in the liner and can provide relative rigidity to the resulting package.

Figure 1:
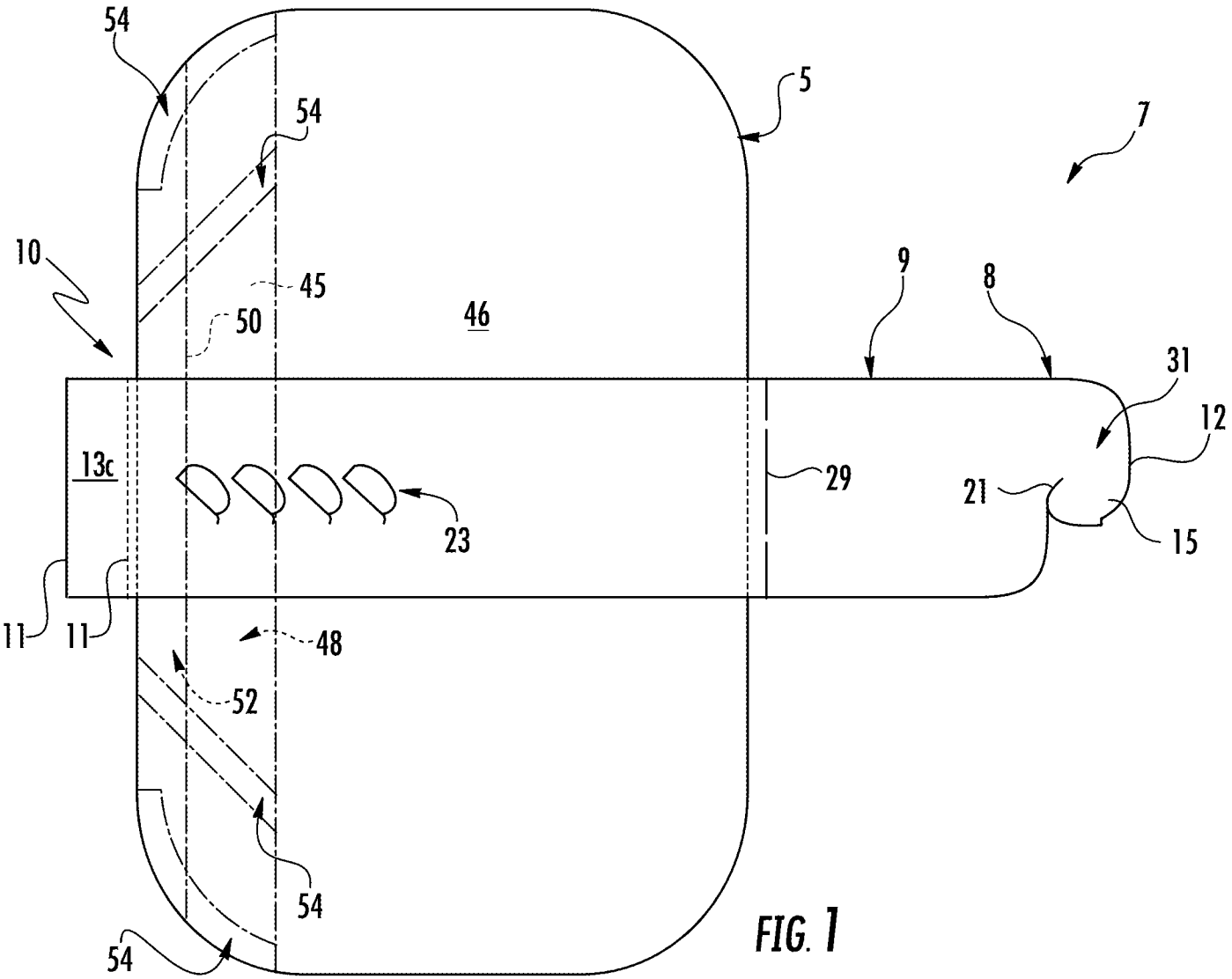
FIG. 1 is an exterior view of a reinforced package including a folded construct and a liner according to an exemplary embodiment of the disclosure.
Figure 5:
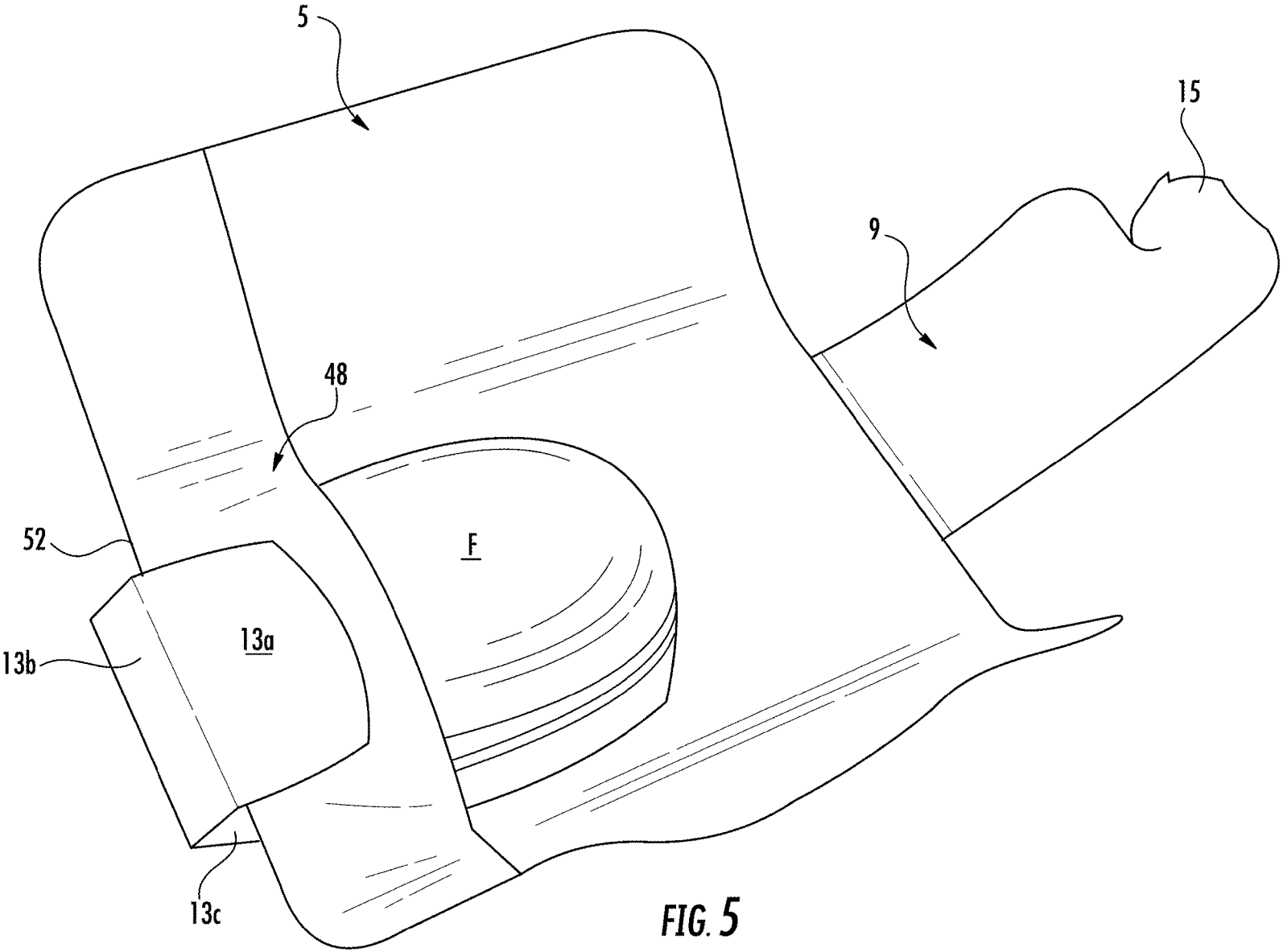
FIG. 5 is a perspective view showing a food item disposed in a pouch of the reinforced package of FIG. 4 according to the exemplary embodiment of the disclosure.
Figure 6:
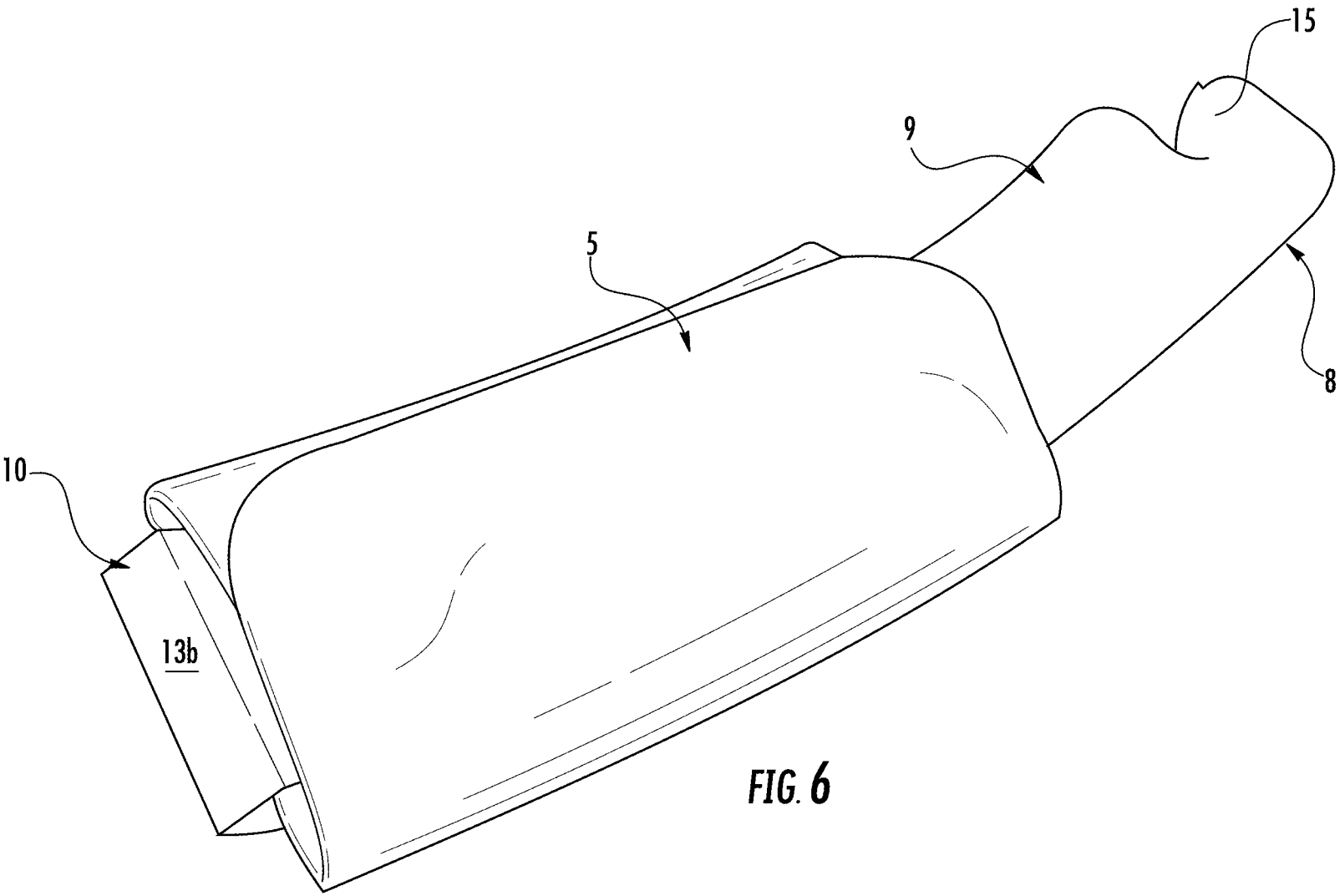
FIGS. 6 and 7 are perspective views showing the folding of the reinforced package of FIG. 5 according to the exemplary embodiment of the disclosure.
Figure 7:
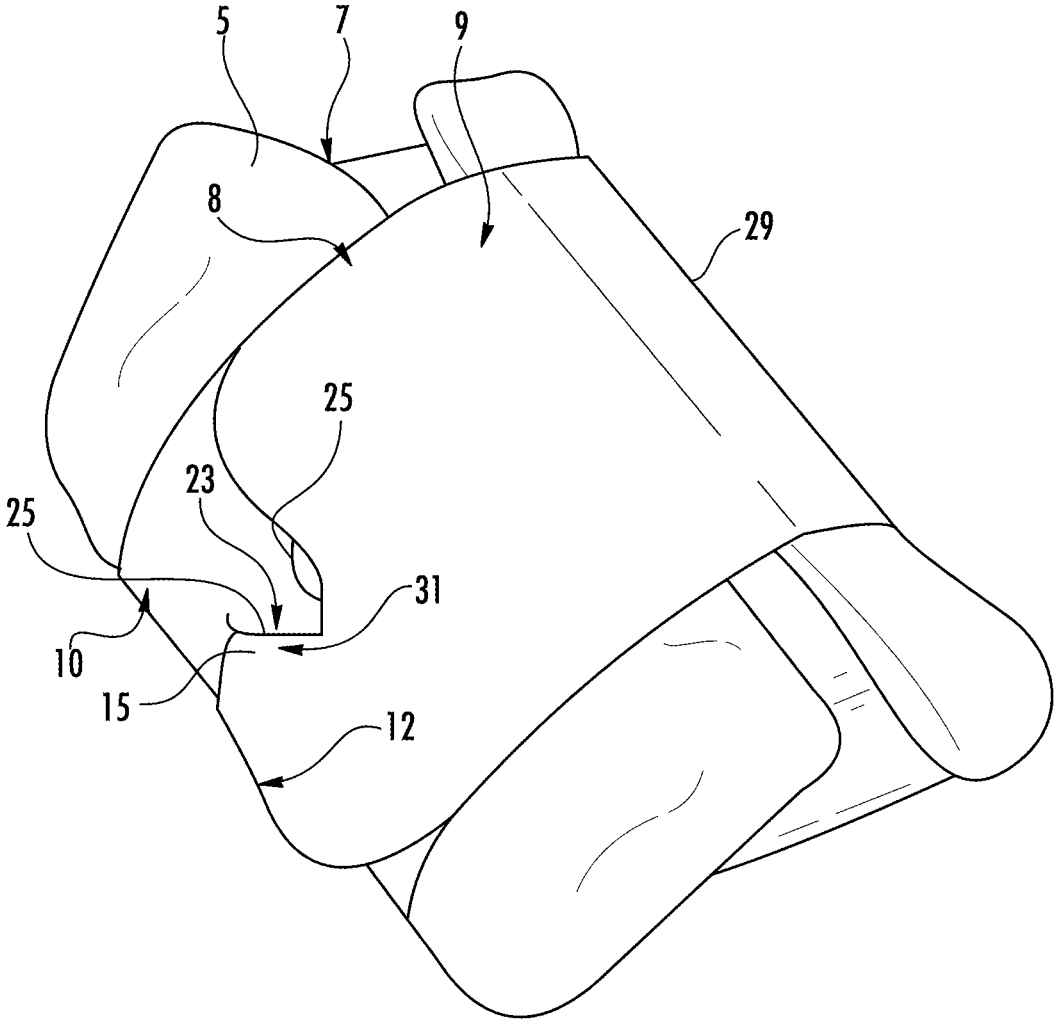

FIG. 1 illustrates a reinforced package generally indicated at 7 for containing a food product F (FIG. 5), according to one embodiment of the disclosure. The package 7 includes a folded construct 9 formed from a construct or blank 3 (FIG. 2) and a liner 5 attached to the construct. FIG. 1 shows the exterior surface of the folded construct 9 with a portion of the liner 5 behind the folded construct, and the hidden features of the liner 5 in FIG. 1 are shown in phantom. In one embodiment, the folded construct 9 wraps around the food product that is contained or wrapped in the liner 5 (FIGS. 5-7). In some embodiments, the construct 9 is used to carry the food product and reinforce the package 7. The package 7 can contain the food product that can be a fast-food item (e.g., sandwich, burrito, wrap, taco, etc.) or any other food item. In one embodiment, the liner 5 can comprises a flexible sheet of material, for example, paper, a polymer film, metallic foil, etc., that may be suitable for forming a flexible package, such as a pouch, or may otherwise be suitable for wrapping the food product. The construct 3 and folded construct 9 can comprise a reinforcing sheet comprising a dimensionally stable and/or somewhat rigid or stiff material (e.g., paperboard) that may be suitable for being folded into a desired structure and substantially maintain its configuration, while providing some inherent degree of flexibility to the package 7. The construct 9 can have locking features for securing the construct to the food product in a locked arrangement and features for facilitating forming of the construct around the food product.

The package 7, the construct 3, the liner 5, and the folded construct 9 are shown and described in one exemplary embodiment of the disclosure, and the package 7 can be formed by one embodiment of the system and method of the present disclosure. Further embodiments of blanks, liners, constructs, and packages that are applicable to the present disclosure and that can be formed by one embodiment of the system and method of the present disclosure are included in the incorporated-by-reference U.S. patent application Ser. No. 14/919,072, filed Oct. 21, 2015. Various other designs and embodiments of the blank, liner, folded construct, and package could also be suitable for formation by one embodiment of the system and method of the present disclosure.

Figure 2:
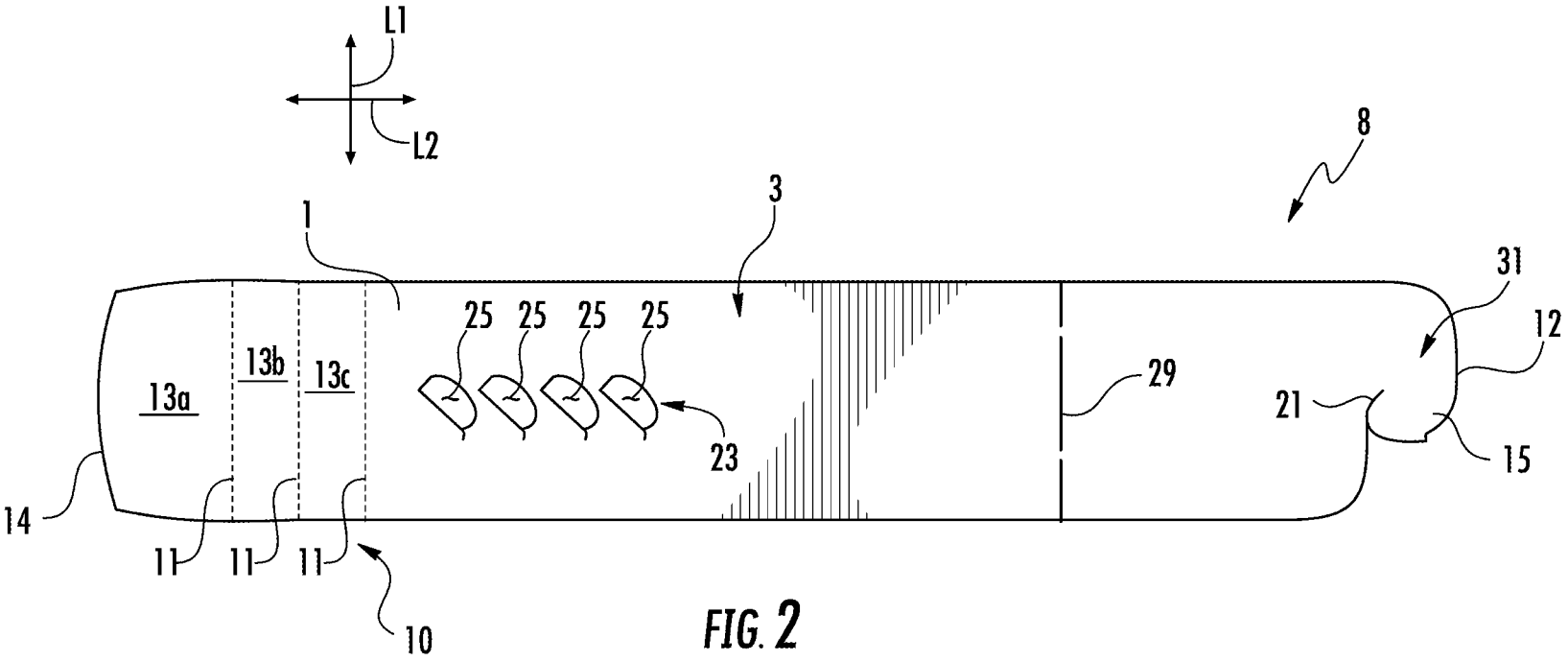
FIG. 2 is a plan view of an exterior side of a blank or construct used to form the folded construct of FIG. 1 according to the exemplary embodiment of the disclosure

As shown in FIG. 2, the construct or blank 3 has a lateral axis L1 and a longitudinal axis L2. The blank 3 can include a first portion 8 at a first end 12 and a second portion 10 proximate to a second end 14. A plurality of lateral fold lines 11 can extend across the width of the blank 3 at the second portion 10 generally near the second longitudinal end 14 of the blank. The fold lines 11 can form independently moveable end panels 13*a*, 13*b*, 13*c* in the second portion 10 of the blank 3. Another lateral fold line 29 can extend adjacent the first portion 8 of the blank. As shown in FIG. 2, the blank 3 includes a male locking feature 15 at the first longitudinal end 12 of the blank. In one embodiment, the male locking feature 15 has a curved cut 21 that extends from the generally curved edges of the blank 3. In one embodiment, the cut 21 can at least partially form a male locking tab 31 of the male locking feature 15. In the illustrated embodiment, the second portion 10 of the blank 3 can include a female locking feature 23 that can include a plurality of openings 25 having curved cuts at respective corners of the openings. The male locking tab 31 can be shaped for being received in a selected one of the openings 25 of the female locking feature 23 so that the male locking tab 31 at least partially interlocks with the respective female locking opening 25. The blank 3 including at least the male locking tab 15 and the female locking feature 23 could have other features and could be otherwise shaped, arranged, positioned, and/or configured without departing from the disclosure.

Figure 3:
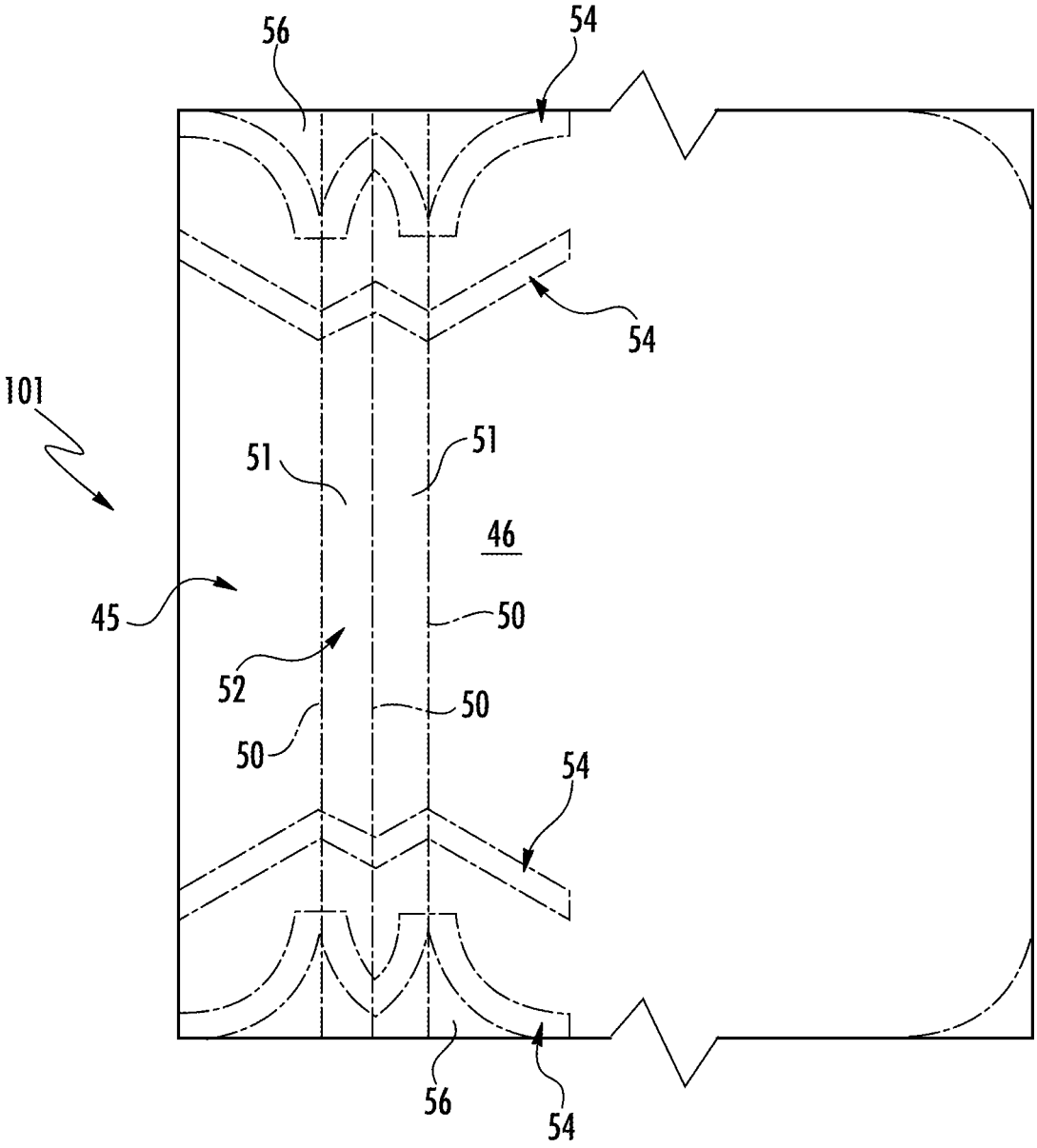
FIG. 3 is a plan view of a portion of a web of material for forming the liner of FIG. 1 according to the exemplary embodiment of the disclosure.

According to the illustrated embodiment, FIG. 3 shows a portion of a web of material 101 (e.g., see FIG. 8) that can be formed into the liner 5. As shown in FIGS. 1 and 3, the liner 5 and/or the web of material 101 can include a bottom marginal portion 45 connected to a central portion 46 by a gusset 52 with folds 50. Scrap portions 56 can be removed from the gusset 52, the bottom marginal portion 45, and the central portion 56 during formation of the package 7 as described in more detail below so that the liner 5 has rounded corners. As shown in FIG. 3, the liner 5 can include seal features 54, which can include adhesive (e.g., a heat activated glue) for at least partially sealing the end portions of the pouch 48 as described below in more detail. Alternatively, the web of material 101 can comprise a heat sealable material (e.g., a thermoplastic) and the seal features 54 could be sealed by raised features on a heat sealer, for example.

In the illustrated embodiment, the gusset 52 can include three folds 50 in the liner 5 so that two gusset panels 51 are foldably connected to the respective bottom marginal portion 45 and central portion 46 along respective folds 50, and so that the gusset panels 51 are foldably connected to one another along the intermediate fold 50. In one embodiment, the folds 50 can be generally perpendicular to the longitudinal axis L2 and to the length of the blank 3 as shown in FIG. 1. As shown in FIG. 3, the folds 50 could be formed in the web 101 prior to forming the liner 5 and the package 7. Alternatively, the folds 50 could be formed in the web during the formation of the liner 5. The web of material 101 and/or the liner 5 could be otherwise shaped, arranged, positioned, and/or configured without departing from the disclosure. For example, one or more of the seal features 54 could be omitted. In an alternative embodiment, the gusset 52 could be omitted and the bottom marginal portion 45 of the liner 5 could be foldably connected to the central portion 46 along a fold 50.

Figure 4:
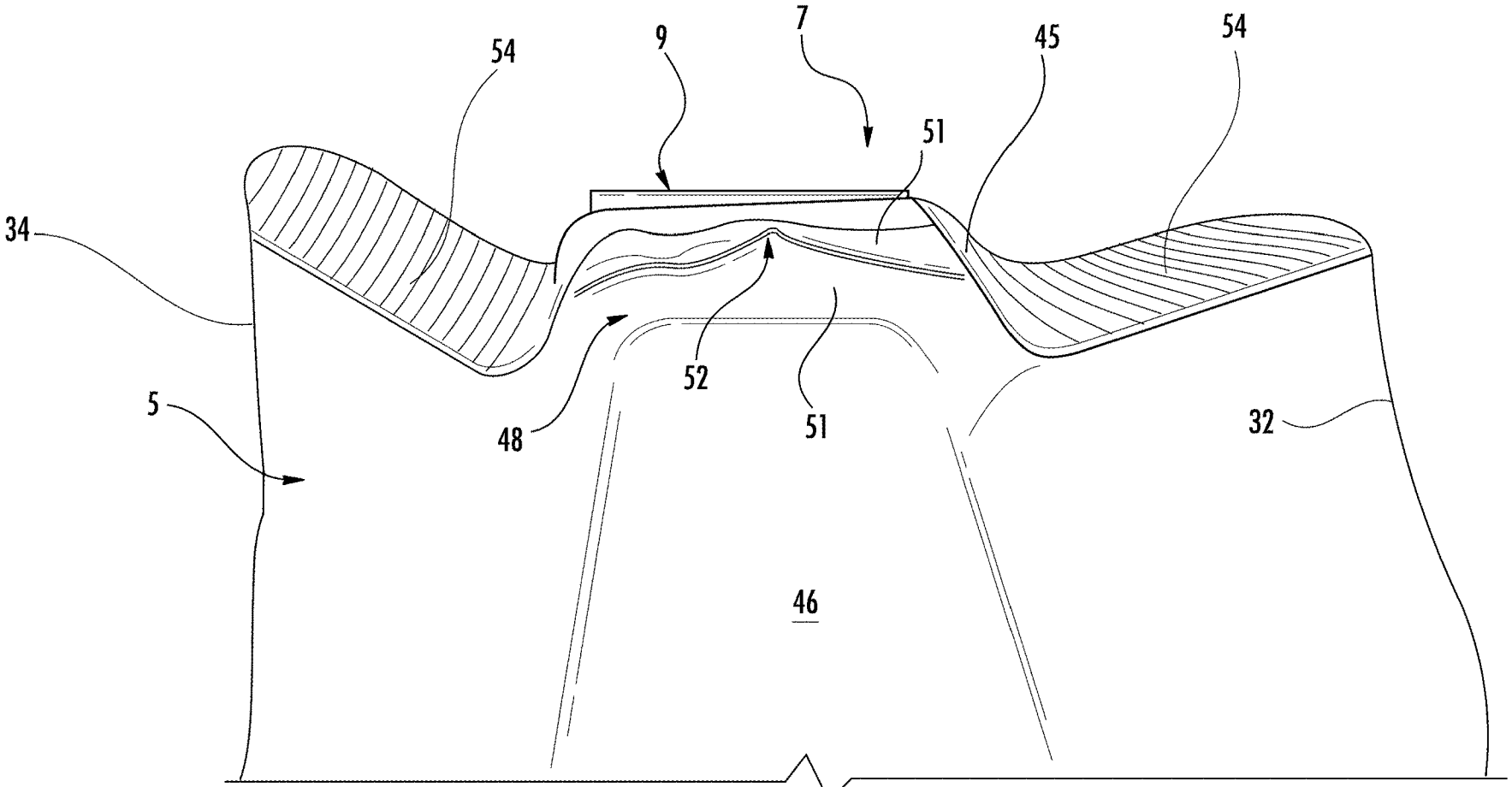
FIG. 4 is a perspective view of the reinforced package of FIG. 1 according to the exemplary embodiment of the disclosure.

As shown in FIGS. 1 and 4, and as described in more detail below with reference to FIGS. 8-21, package 7 can be formed, for example, by attaching the blank 3 to the web of material 101, folding the web of material 101 to form a pouch 48, folding the blank 3 to form the folded construct 9, sealing the ends of the pouch at the seal features 54, and separating the liner 5 from a remainder of the web. In one embodiment, and as described in more detail below with reference to FIGS. 8 and 14-16, the pouch 48 can be formed in the web of material 101 by folding the bottom marginal portion 45 over the central portion 46 and folding the gusset 52 inwardly so that the gusset panels 51 are disposed between the bottom marginal portion 45 and the central portion 46 of the web 101. In the illustrated embodiment, and as described in more detail below with reference to FIGS. 8, 17, and 18, the folded construct 9 can be formed by folding one or more of the end panels 13*a*, 13*b*, 13*c* along the respective fold lines 11 over the bottom marginal portion 45 and the gusset 52 of the web. For example, as shown in FIG. 1, the end panels 13*a*, 13*b* can be folded with respect to the end panel 13*c* and the remainder of the blank 3 over the pouch 48. In one embodiment, one or more of the end panels 13*a*, 13*b*, 13*c* can be at least partially adhered to the web 101 and/or the liner 5. In one embodiment, and as described in more detail below with reference to FIGS. 8 and 19, the ends of the pouch 38 can be sealed by sealing (e.g., heat sealing) the folded bottom marginal portion 45, gusset 52, and central portion 46 of the web 101 together at at least the seal features 54. In the illustrated embodiment, the pouch 48 is oriented to be generally transverse to the longitudinal length of the blank 3 (e.g., along the width of the blank) and disposed on the second portion 10 adjacent the panel 13*c*. In one embodiment, the panels 13*a*, 13*b*, 13*c* serve as a convenient place to hold the food item F when the package is partially unwrapped for holding and/or consuming at least a portion of the food item. The package 7, including the liner 5 and/or the construct 9, could be otherwise formed without departing from the disclosure. For example, the blank 3 could be attached to the web 101 so that the length of the blank is generally parallel to the pouch 48.

As shown in FIG. 4, the pouch 48 can be opened such as by folding the unsealed portion of the bottom marginal portion 45 (e.g., between the seal features 54) upwardly and expanding the gusset 52. In addition, the end panels 13*a*, 13*b*, 13*c* of the construct 9 can be folded with respect to one another along the fold lines 11 as the pouch 48 is opened. As shown in FIG. 5, a food item F can be inserted at least partially into the pouch 48. The gusset 52 can expand and the end panels 13*a*, 13*b*, 13*c* can fold with respect to one another as needed to accommodate the size of the food product F in one embodiment. As shown in FIG. 6, the sides of the liner 5 can be folded over the food item F and one or more of the end panels 13*a*, 13*b*, 13*c*. As shown in FIG. 7, the first portion 8 of the blank 3 can be folded over the second portion 10 and the food item F, the top marginal portion of the liner 5 folding over the food item F as well at least partially enwrap the food product. Accordingly, FIG. 7 shows the package 7 including the liner 5 and the construct 9 wrapped around the food item F to enclose the food item, and the first portion 8 of the construct 9 overlaps the second portion 10 of the construct.

As shown in FIG. 7, the male locking tab 31 can be inserted into a selected female locking opening 25 of the female locking feature 23 based on the size of the food product and the tightness of the fit of the construct 9 around the food product. In one embodiment, the fold lines 11 and the end panels 13*a*, 13*b*, 13*c* facilitate the formation of the pouch 48 by allowing the liner 5 to expand and hold the food product F. Additionally, the lateral fold lines 11, 29 can help the construct 9 to at least partially conform to the shape of the food item F. The package 7 could be formed by additional or different steps without departing from the disclosure. Additionally, the first portion 8 and the second portion 10 of the construct 9 can be otherwise engaged and/or secured to one another. For example, in addition or alternatively to the male locking feature 15 and the female locking feature 23, the first portion 8 and the second portion 10 could be secured together by an adhesive (e.g., an adhesive sticker, retack glue, and/or tape) or any other suitable securing method.

Figure 8:
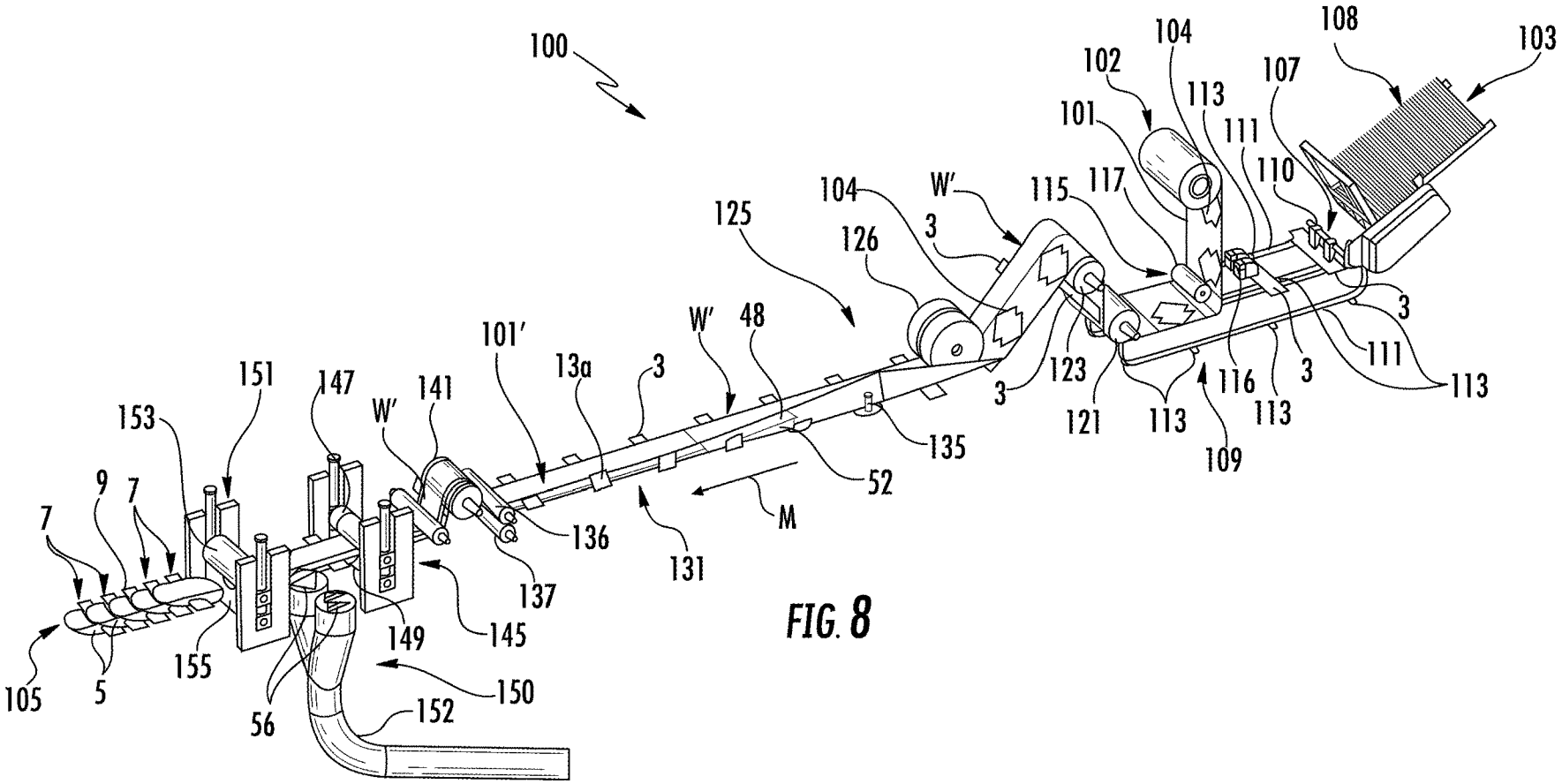
FIG. 8 is a schematic illustration of a system and method of forming reinforced packages according to the exemplary embodiment of the disclosure.

FIG. 8 generally illustrates an example embodiment and various example components of a system and method 100 for forming the reinforced packages (e.g., reinforced packages 7) in accordance with the disclosure. In the illustrated embodiment, the packaging system 100 attaches the web of material 101 for forming the liners 5 of the packages 7 to the constructs 3, which can be folded to form folded constructs 9, and the attached constructs and web move through a respective packaging system or machine 100 from an upstream end 103 to a downstream end 105 generally in a machine direction M, and are formed into the individual packages by various portions and components of the system as discussed further below. The system and method 100 of the present disclosure can have similar or identical features, methods, processes, and/or components as the system and methods disclosed in incorporated-by-reference U.S. Provisional Patent Application No. 62/179,172, filed Apr. 29, 2015, and U.S. patent application Ser. No. 15/142,103, filed Apr. 29, 2016.

As illustrated in FIG. 8, in one embodiment 100 of the system and method for manufacturing reinforced packages 7, the web of liner material 101, which can include paper, polyethylene or other material including flexible and heat-sealable materials, is fed from a roll or supply 102. The liner material 101 can be unprinted or preprinted with various designs, lettering, labels or other graphics and can be perforated, printed roll stock that can include patterned adhesive 104 (e.g., a heat activated adhesive) that is positioned to facilitate forming the web 101 into the liners 5 having bottom end portions 45 that overlap main or central portions 46 of the liner and have pouches 48, gussets 52, and sealed regions 54. The patterned adhesive 104 is shown schematically in FIG. 8. In an alternative embodiment, the adhesive 104 could be applied to the web of material 101 after it is unrolled from the supply 102. The adhesive 104 could be disposed on the web in seal areas forming seal features (e.g., seal features 54 described above). As noted above, the gussets 52 or other features of the liners 5 can be omitted or modified without departing from the disclosure.

In one embodiment, a carton feeder 107 is positioned at the upstream end 103 of the system 100 and includes a stack 108 of constructs 3 that are fed to a blank conveyor 109. The blank conveyor 109 moves the constructs 3 in the machine direction M towards the web 101 of bag material. In one embodiment, the carton feeder 107 is a pick and place type carton feeder, as shown in FIG. 8, that includes an arm 110 that picks a construct 3 from the stack 108 and transfers it to the blank conveyor 109. A pick and place type carton feeder is further shown in FIGS. 5, 6A, and 6B of incorporated-by-reference U.S. patent application Ser. No. 15/142,103, filed Apr. 29, 2016. Alternatively, as shown in FIGS. 9-11 and 13, the carton feeder 107 could be replaced by a belt driven carton feeder 207 that conveys a construct 3 from the stack at relatively higher speeds than the pick and place type carton feeder 107. The carton feeder could comprise other types of feeders such as mechanisms that convey blanks 3 directed from a blank cutting station, or any other suitable types of feeders or other mechanisms without departing from the disclosure. For example, the upstream end 103 of the system 100 could include inline printing machines and processes that print graphics and other features on the roll of paperboard material and die cutters or other cutting machines and processes that cut the printed roll directly into blanks 3 that are directly fed from the die cutters to the blank conveyor 109. Any other suitable processes and apparatus for processing the blanks 3 could be included without departing from the scope of this disclosure.

As shown in FIGS. 8-13, the blank conveyor 109 includes two spaced apart belts or tracks 111 with lugs 113 for engaging a series of constructs 3 and conveying the constructs in the machine direction M. A lug 113 on one of the spaced apart lug belts 111 cooperates with a lug 113 on the other lug belt 111 to convey a respective construct 3 in the blank conveyor 109. In the illustrated embodiment, the lug belts 111 can be endless belts, each with a plurality of the lugs 113 spaced along the respective belt. In one embodiment, the lugs 113 can be spaced on the lug belts 111 by approximately the width of the liners 5 in the reinforced packages 7. The blank conveyor 109 receives the constructs 3 from the carton feeder 107 (FIG. 8) or the carton feeder 207 (FIGS. 9-13) and moves the series of constructs 3 from the carton feeder 107 or 207 to an attachment assembly 115 of the packaging system 100 wherein the web of material 101 is attached to the constructs 3 by adhesive. As shown in FIGS. 9-11 and 13, the blank conveyor 109 can include one or more stop bars 112 or other suitable features that can engage the constructs 3 as the lug belts 111 move the constructs 3 past the stop bar 112. Accordingly, as the lug belts 111 move the constructs 3 downstream, the stop bar 112 can hold the constructs 3 until respectively adjacent lugs 113 move downstream on the respective belts 111 to engage an upstream end of the construct 3. Accordingly, in one example, the constructs 3 can be properly positioned for attachment to the web of material 101 in the attachment assembly 115. Subsequently, the lugs 113 can push the respective constructs 3 toward the attachment assembly 115.

Figure 9:
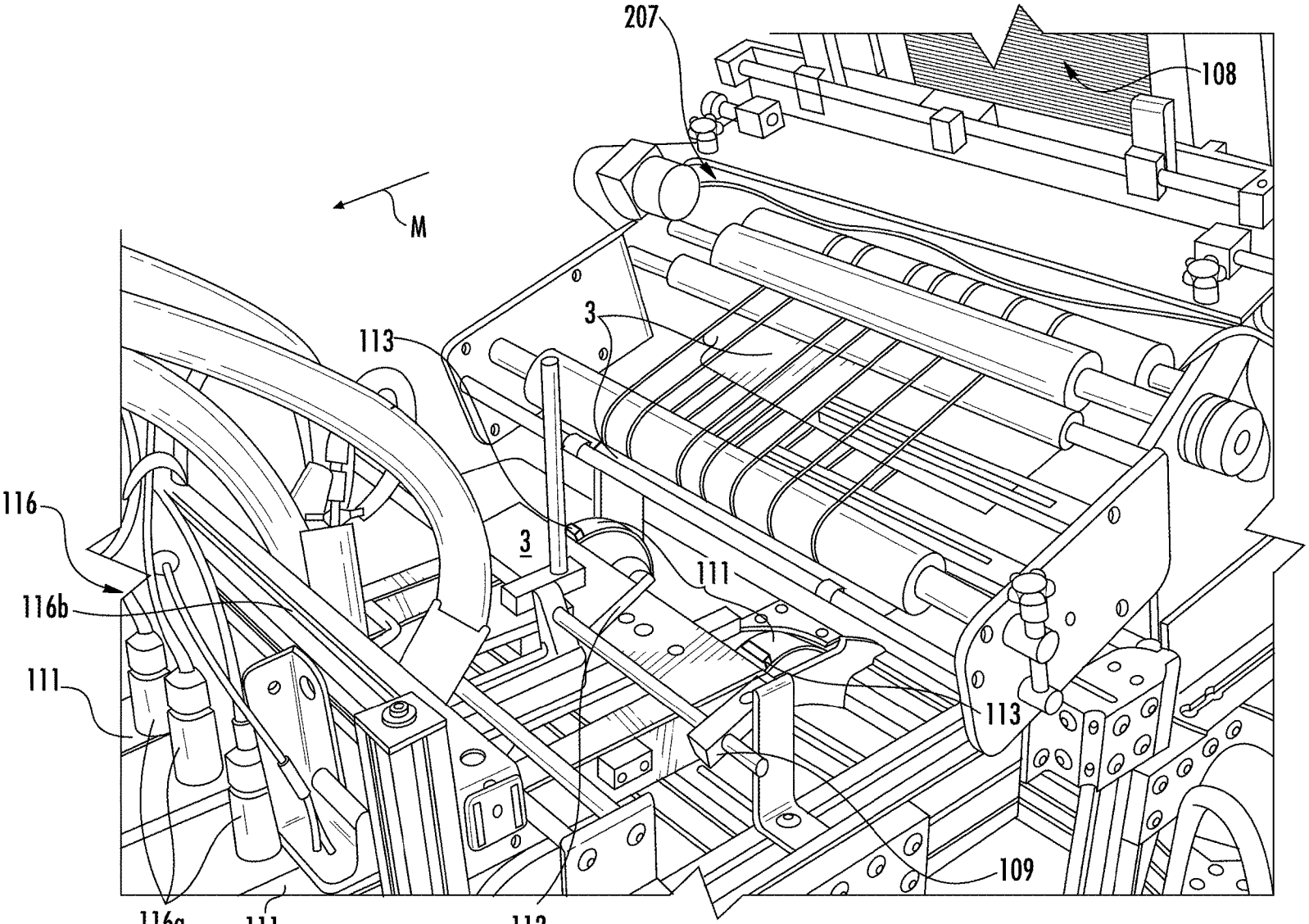
FIGS. 9-13 are perspective views of a carton feeder, an adhesive applicator, and an attachment assembly of the system of FIG. 5 schematically showing the carton feeder, the adhesive applicator, and the attachment assembly feeding constructs and attaching the constructs to a web of material to form an attached web according to the exemplary embodiment of the disclosure.
Figure 10:
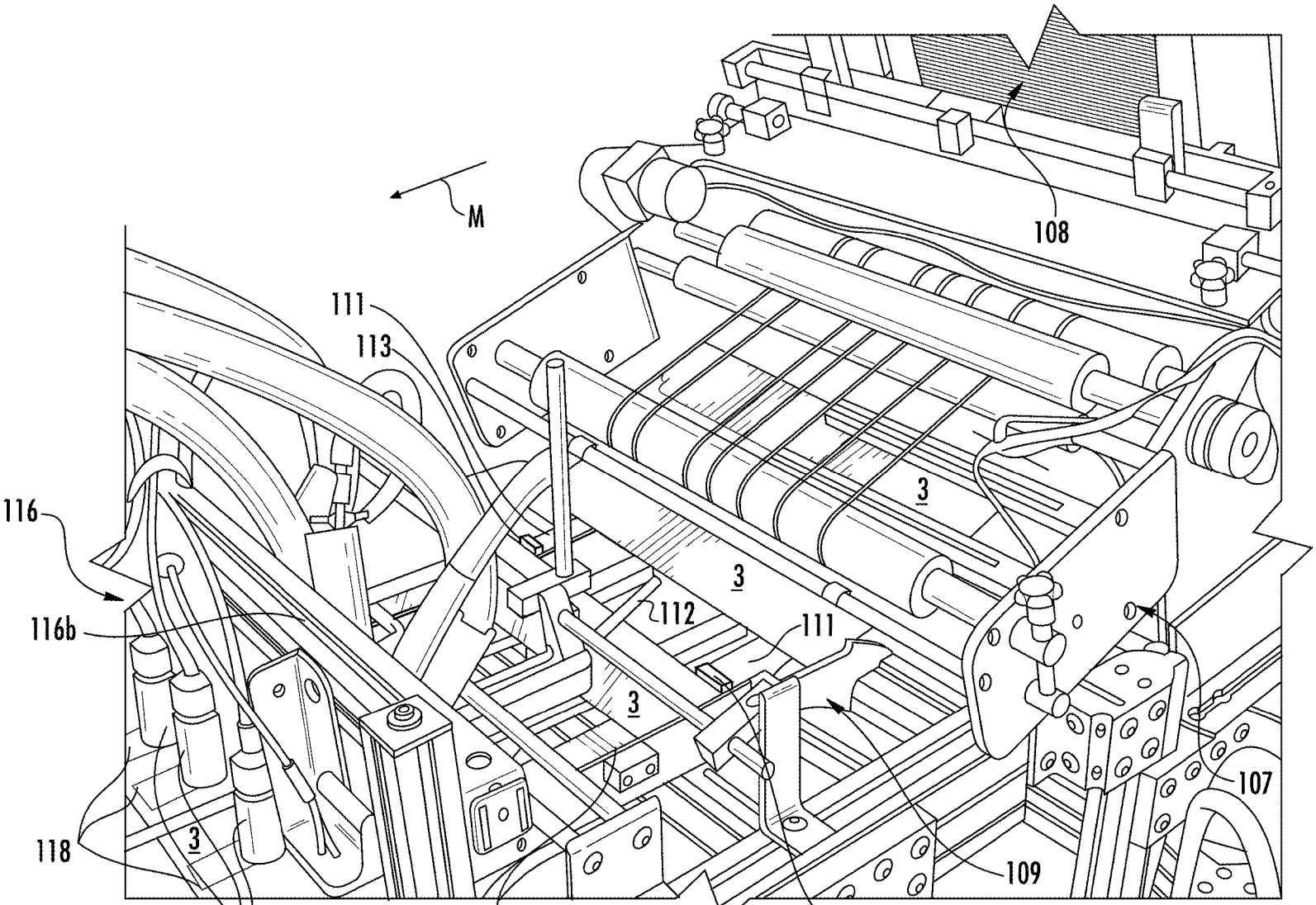
Figure 11:
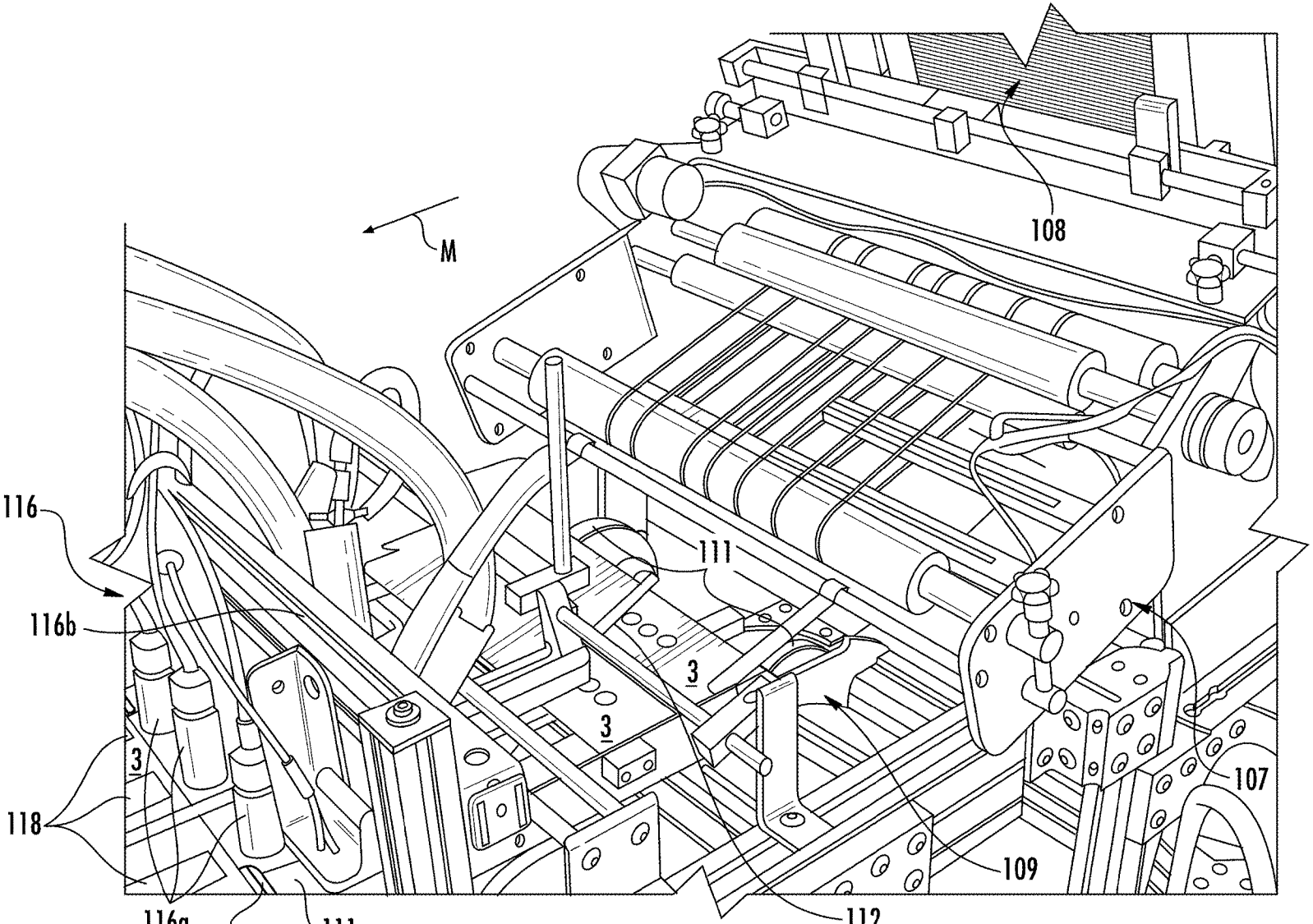

In one embodiment, a construct 3 on the blank conveyor 9 can be engaged by the stop bar 112 and two lugs 113 can engage the upstream edge of the construct 3 to push the construct 3 downstream past the stop bar 112 as shown in FIG. 9. As the construct 3 moves downstream on the blank conveyor 109, a subsequent construct can be ejected from the carton feeder 207 (FIG. 10), and can be guided onto the lug belts 111 (FIG. 11). The subsequent construct 3 may move on the belts 111 (e.g., due to friction), but the construct 3 can engage the stop bar 112, which can retain the construct 3 until subsequent lugs 113 engage the subsequent construct 3. Meanwhile, the downstream construct 3 can continue to be pushed downstream by the lugs 113. Accordingly, in one embodiment, the constructs 3 can be spaced apart on the blank conveyor 109. The constructs 3 could alternatively be received and/or positioned on the blank conveyor 109 without departing from the disclosure.

Figure 12:
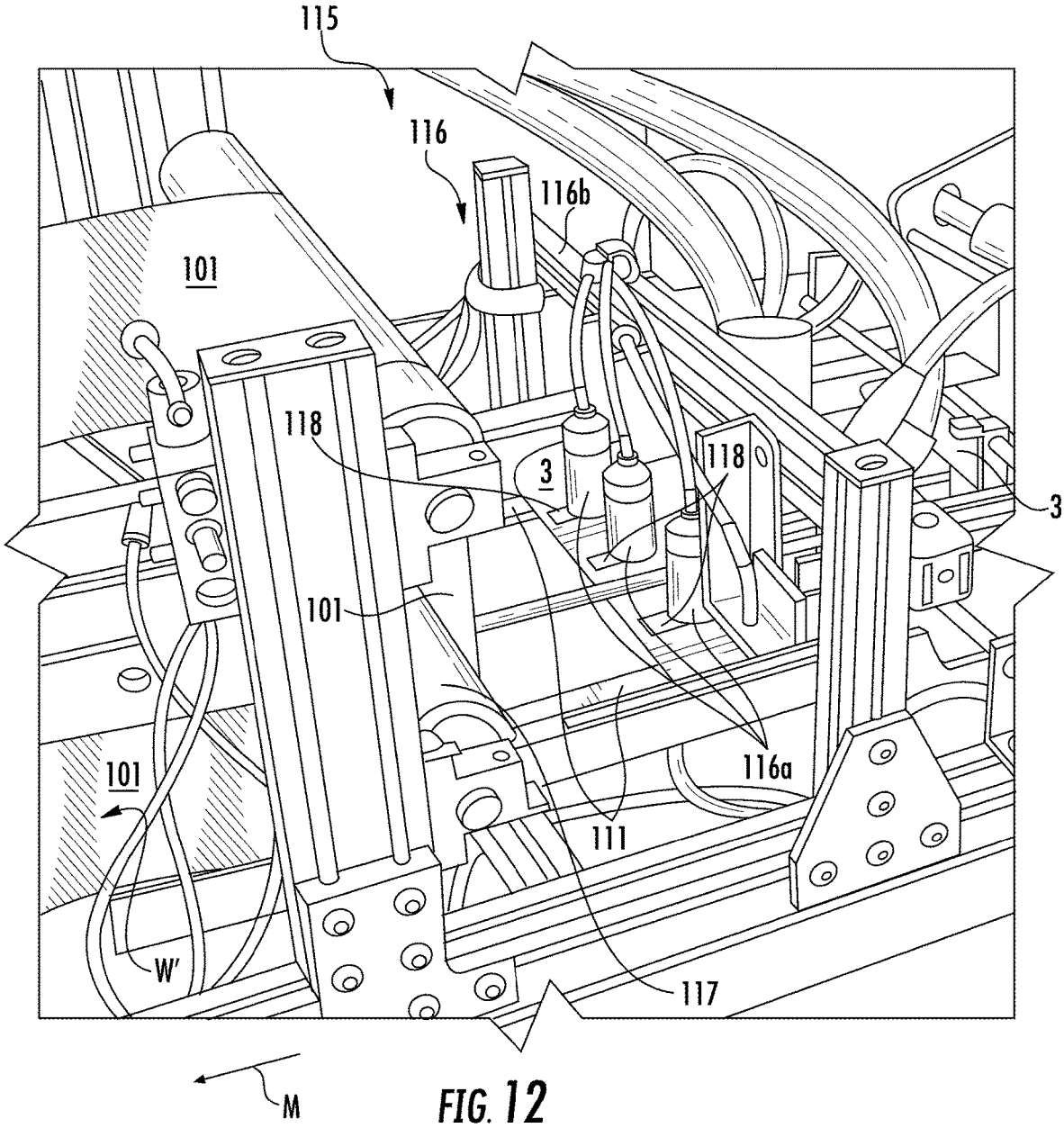
Figure 13:
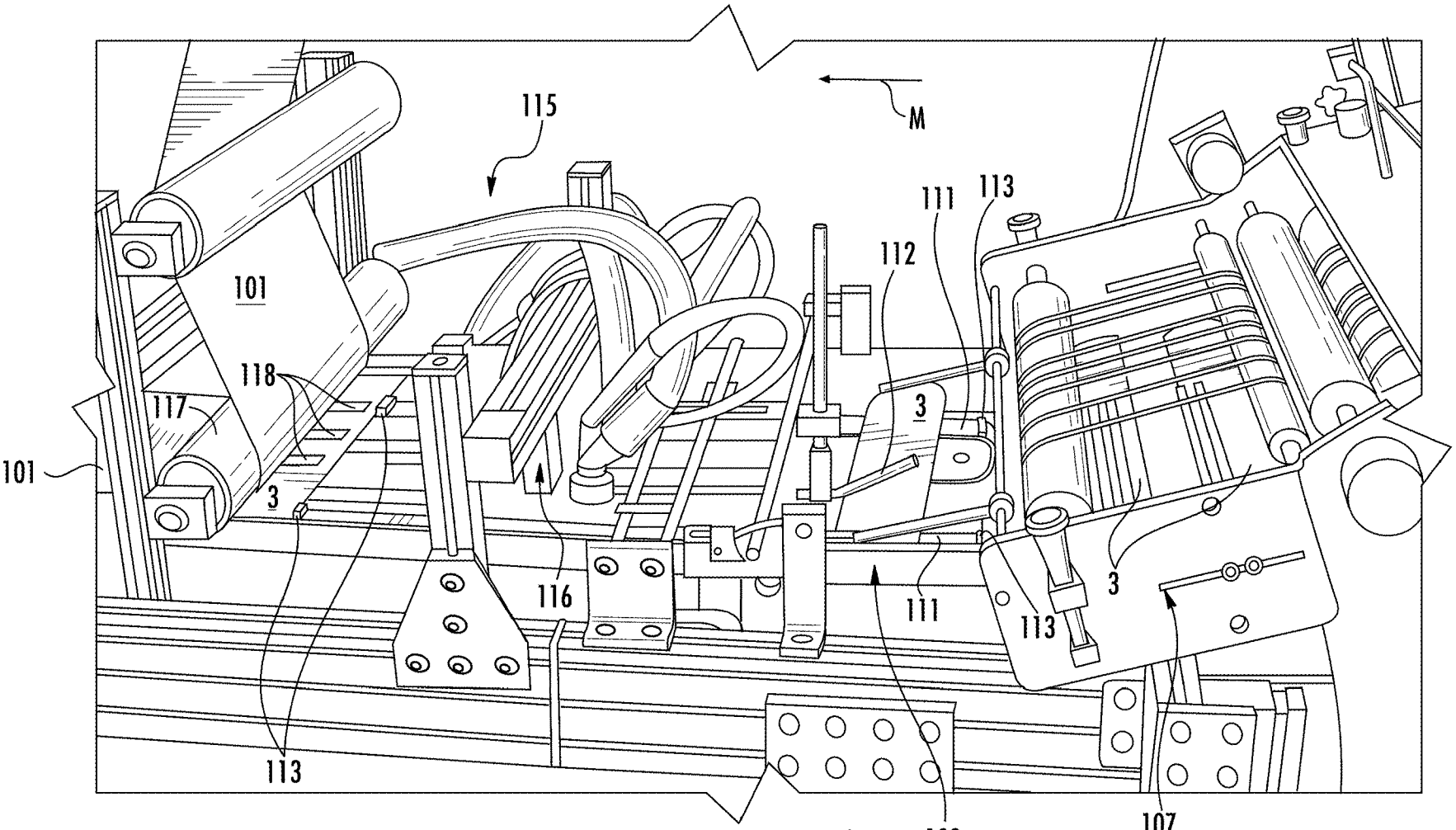

In one embodiment, the attachment region 115 of the system 100 includes an adhesive applicator 116 (FIGS. 8-13) for applying adhesive to the constructs 3. In one embodiment, the adhesive applicator 116 can include one or more adhesive outlets 116*a* mounted on a frame 116*b* above the blank conveyor 109 so that the adhesive applicator 116 can apply an adhesive (e.g., adhesive 118 shown schematically in FIGS. 10-12) to the upper surfaces of the constructs 3 as they pass under the adhesive applicator 116 and prior to engaging the constructs 3 with the web of material 101. As shown in FIGS. 8, 12, and 13, the web of material 101 can be unrolled from the roll 102 over one or more rollers and directed to move in the machine direction M over (e.g., generally parallel to) the lug belts 111 so that the web of material 101 can be brought into contact with the constructs 3 in the attachment assembly 115. In the illustrated embodiment, the attachment assembly 115 can include an adhesive compression nip roller 117 (FIGS. 8, 12, and 13) downstream from the adhesive applicator 116 over the web of material 101. An opposing nip roller or other surface (not shown) can be disposed below the constructs 3. Accordingly, the nip rollers can receive the web of material 101 and the constructs 3 and press the web of material 101 against the constructs 3 to adhesively attach the web to the constructs via the adhesive 118, for example. In one embodiment, the nip roller 117 and the opposing roller can be disposed between the lug belts 111 so that the lugs 113 can pass by the rollers. The construct 3 can be attached to the web 101 by other suitable mechanisms without departing from the disclosure.

Figure 14:
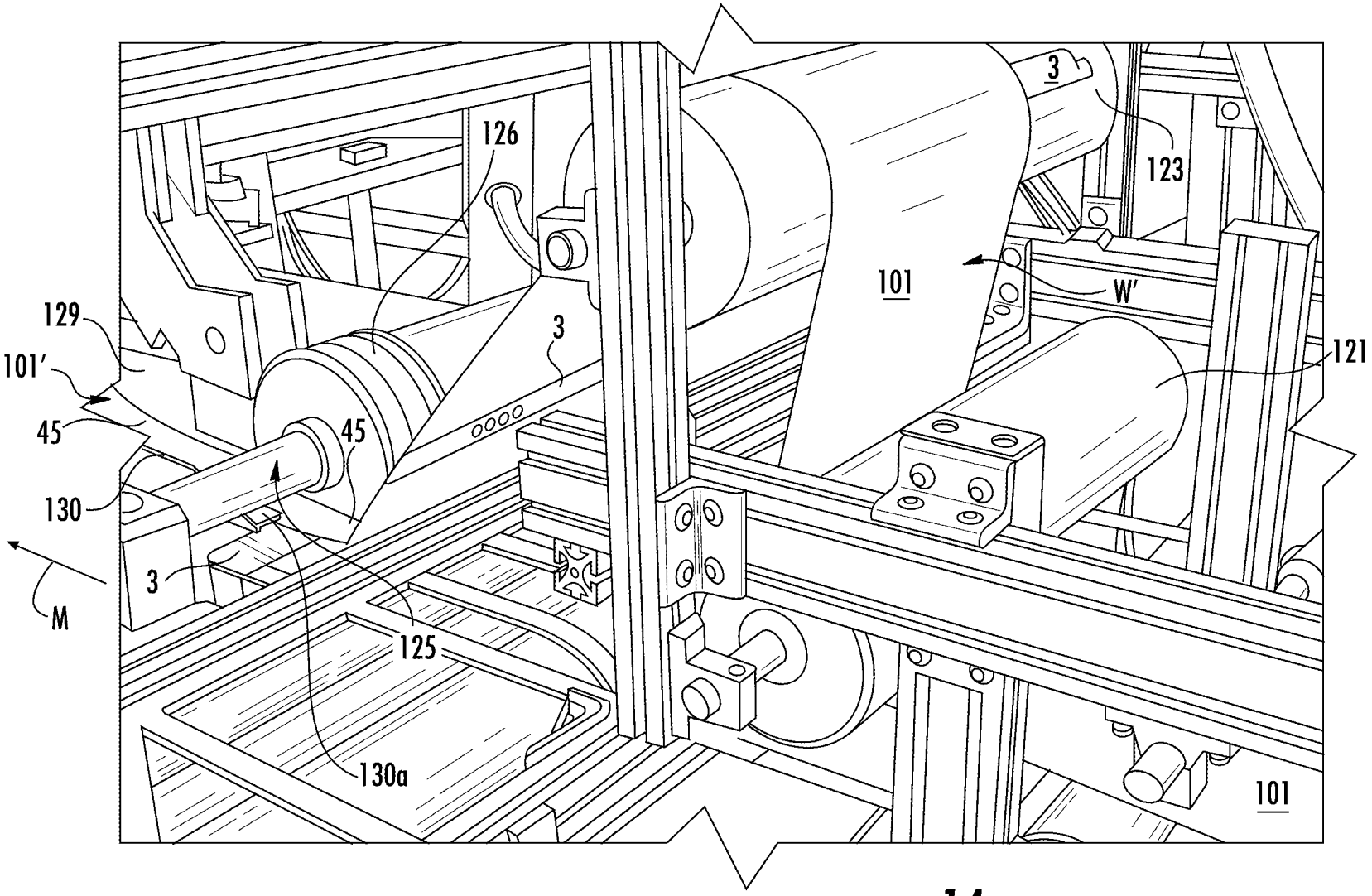
FIGS. 14-16 are perspective views of a we edge forming assembly of the system of FIG. 5 schematically showing the web edge forming assembly forming a folded web according to the exemplary embodiment of the disclosure.
Figure 15:
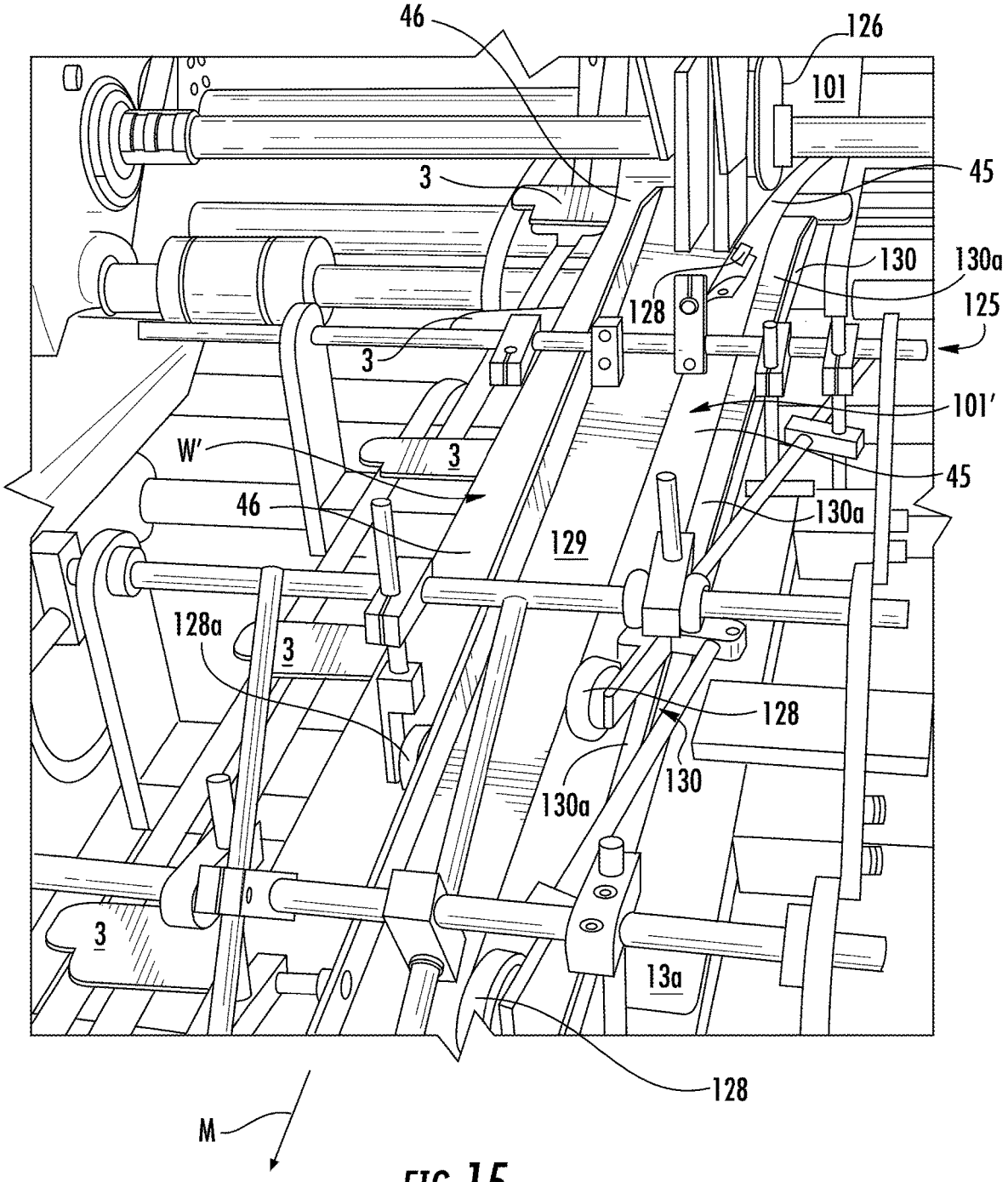
Figure 16:
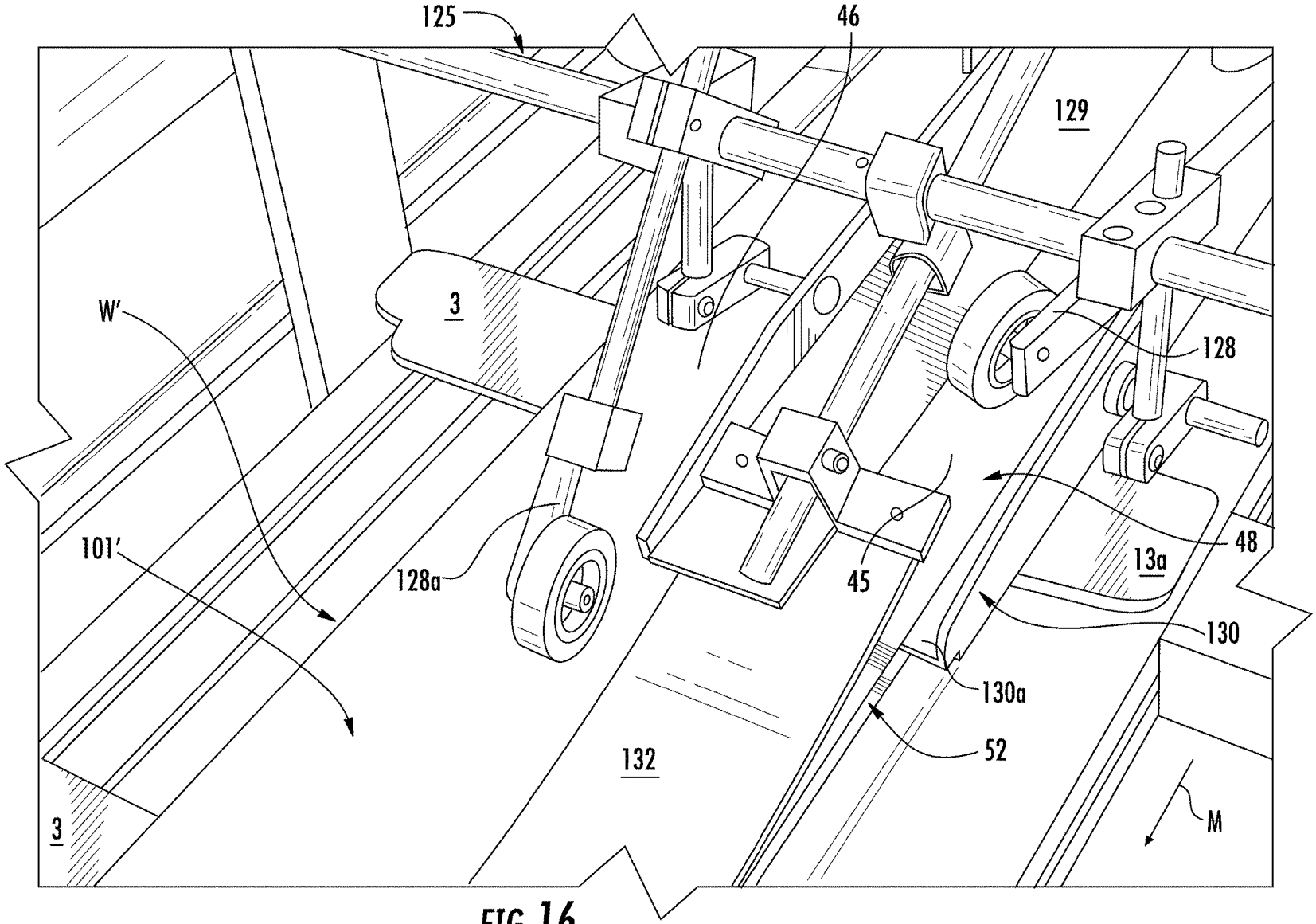

In one embodiment, as shown in FIGS. 8 and 14, the web 101 with constructs 3 attached (hereinafter the attached web W') travels from the blank conveyor 109 through a series of rollers 121, 123 and to a web edge forming assembly 125 (FIGS. 14-16) of the system 100. The web edge forming assembly 125 can include web folding features for forming the web of material 101 into a folded 101'. In one embodiment, the web edge forming assembly 125 includes a forming roll 126 and guides that form and shape the web 101 into the folded web 101' wherein the bottom portion 45 overlaps the main portion 46 of the folded web 101' and the gusset 52 is formed between the bottom portion 45 and the main portion 46 (e.g., as shown in FIGS. 1, 4, 15, and 16). In one embodiment, as shown in FIGS. 14-16, the web edge forming assembly 125 can include a forming roll 126, guide rollers 128, 128*a*, an inner forming plate 129, and an outer guide plate 130 that form and shape the web 101 into the folded web 101' having the side gussets 52 and fold lines 50 (e.g., FIGS. 1, 3, and 4). As shown in FIGS. 14 and 15, the forming roll 126 can engage the main portion 46 of the web of material 101, and the marginal bottom portion 45 of the web of material 101 can fold upwardly at the forming roll 126 to the guide rollers 128. In the illustrated embodiment, the guide rollers 128 can direct the marginal bottom portion 45 over the inner forming plate 129 and adjacent the outer guide plate 130. Additional guide rollers 128*a* (FIGS. 15 and 16) can help direct the main portion 46 of the folded 101'. In one embodiment, the inner forming plate 129 can be spaced apart from the main portion 46 of the folded web so that the gusset portion 52 extends generally vertically between the main portion 46 and the marginal bottom portion 45 and adjacent to the outer guide plate 130. Accordingly, the marginal bottom portion 45 of the folded web 101' is engaged between the inner forming plate 129 and the guide rollers 128 to move the marginal bottom portion from being generally planar with the main portion 46 (e.g., upstream from the forming roll 126) to being at least partially overlapped with and extending over the main portion 46 downstream from the forming roll 128.

In the illustrated embodiment, the gussets 52 of the folded web 101' can be formed by the inner forming plate 129 (FIGS. 15 and 16), the outer guide plate 130 (FIGS. 15 and 16), and a flexible plate 132 (FIG. 16) disposed downstream from the inner forming plate and the outer guide plate. In one embodiment, the inner forming plate 129 can be angled downwardly so that the upstream end of the inner forming plate 129 (FIGS. 14 and 15) is spaced farther from the main portion 46 of the folded web 101' than the downstream end of the forming plate (FIG. 16). Additionally the outer guide plate 130 can include an inwardly-directly horizontal plate 130*a*. The outer guide plate 130 with the horizontal plate 130*a* can be angled inwardly so that the outer guide plate 130 is spaced outwardly from the folded web 101' at the upstream end of the web edge forming assembly 125 (FIGS. 14 and 15), and so that the horizontal plate 130*a* engages the gusset portion 52 of the folded web 101' and pushes it inwardly between the bottom portion 45 and the main portion 46 of the folded web as the inner forming plate 129 lowers the bottom portion 45. Accordingly, in one embodiment, as the attached web W' moves in the machine direction M, the inner forming plate 129 can lower the bottom portions 45 toward the main portion 46 of the folded web 101' while the horizontal plate 130*a* pushes the gusset portion 52 of the folded web 101' inwardly (e.g., folds the gusset panels 51 along the folds 50). As shown in FIG. 16, as the folded web 101' moves downstream from the inner forming plate 129 and the outer guide plate 130, the gusset panels 51 overlap one another between the main portion 46 and the bottom portion 45. The flexible plate 132 can apply downward pressure on the folded web 101' to help form the folds 50 of the gusset 52 and/or to generally flatten the folded web 101'. The web edge forming assembly 125 could be otherwise configured without departing from the disclosure.

Figure 17:
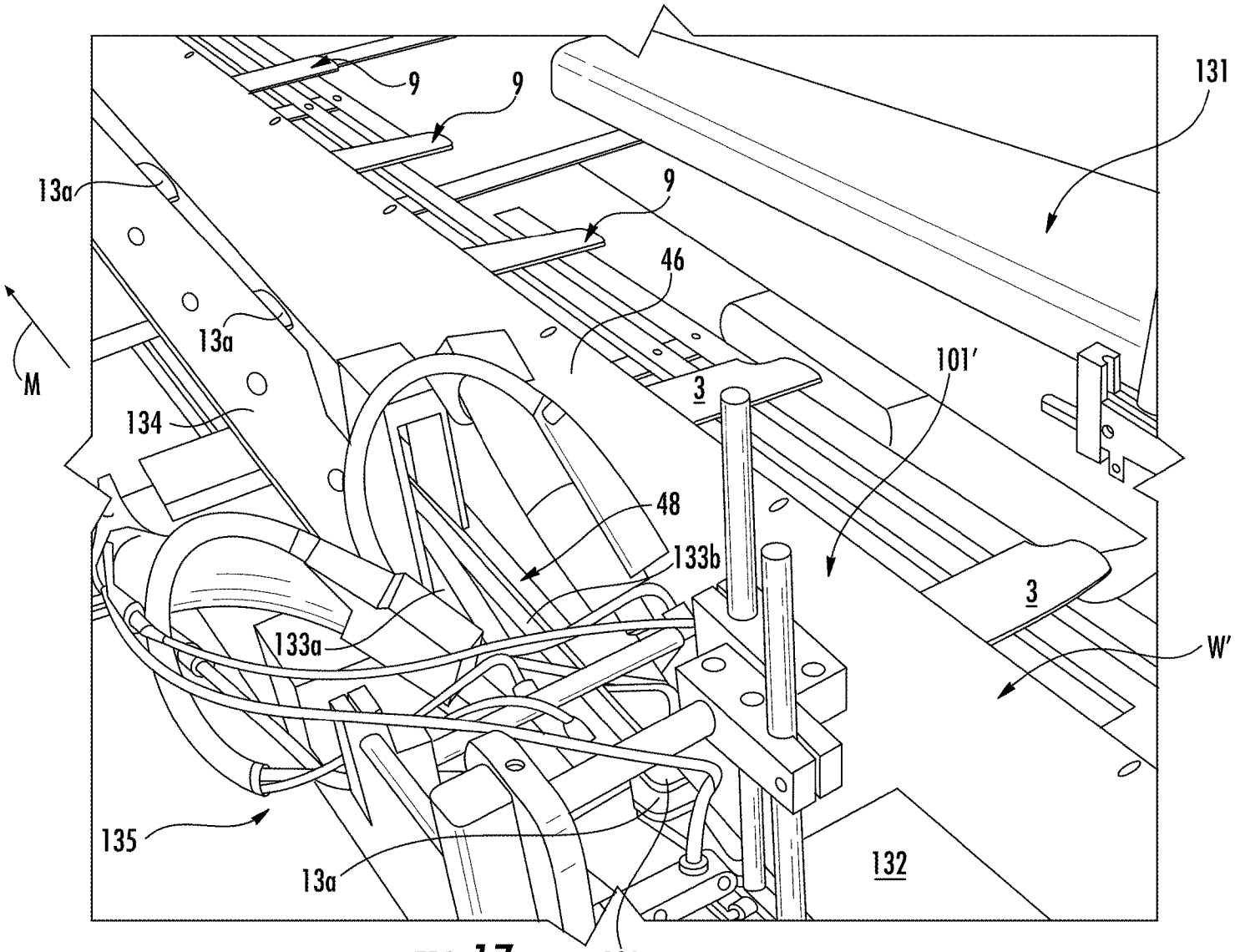
FIGS. 17 and 18 perspective views of a construct forming assembly of the system of FIG. 5 schematically showing the construct forming assembly folding the constructs over the folded web according to the exemplary embodiment of the disclosure.

In one embodiment, the attached web W' moves from the web edge forming assembly 125 to a construct folding assembly 131 of the system 100. In one embodiment, the carton forming assembly 131 includes construct folding features (FIGS. 17 and 18) that position the various flaps and panels of the construct 3. The construct folding assembly 131 can include an adhesive applicator 135 that applies adhesive to the portion of the construct 3 (e.g., end panel 13*a* as shown in FIG. 17) that will overlap the bottom portion 45 of the liner 5 and be attached to the bottom portion. In one embodiment the construct forming assembly 131 includes a series of folders that position the various flaps and panels of the construct 3. In the embodiment of FIG. 8 only one or more of the end panels 13*a*, 13*b*, 13*c* that overlap the bottom portion 45 of the liner 5 is folded to be in face-to-face contact and adhesively attached to the bottom portion, but the construct folding assembly 131 could position or fold other portions of the construct 3 without departing from the disclosure. Also, the construct forming assembly 131 could include a carton adhesive applicator for applying adhesive to the construct 3 so that panels or portions of the construct can be overlapped and adhered to together as the attached web W' moves through the construct forming assembly 131. As shown in FIG. 8, the features of the construct folding assembly 131 can at least partially overlap with the web edge forming assembly 125 so that the adhesive applicator 135 can apply glue to the constructs 3 and the constructs 3 can be folded as the folded web 101' is formed. Alternatively, as shown in FIGS. 17 and 18, the glue can be applied to the constructs 3 and the constructs 3 can be folded downstream from the web edge forming assembly 125.

Figure 18:
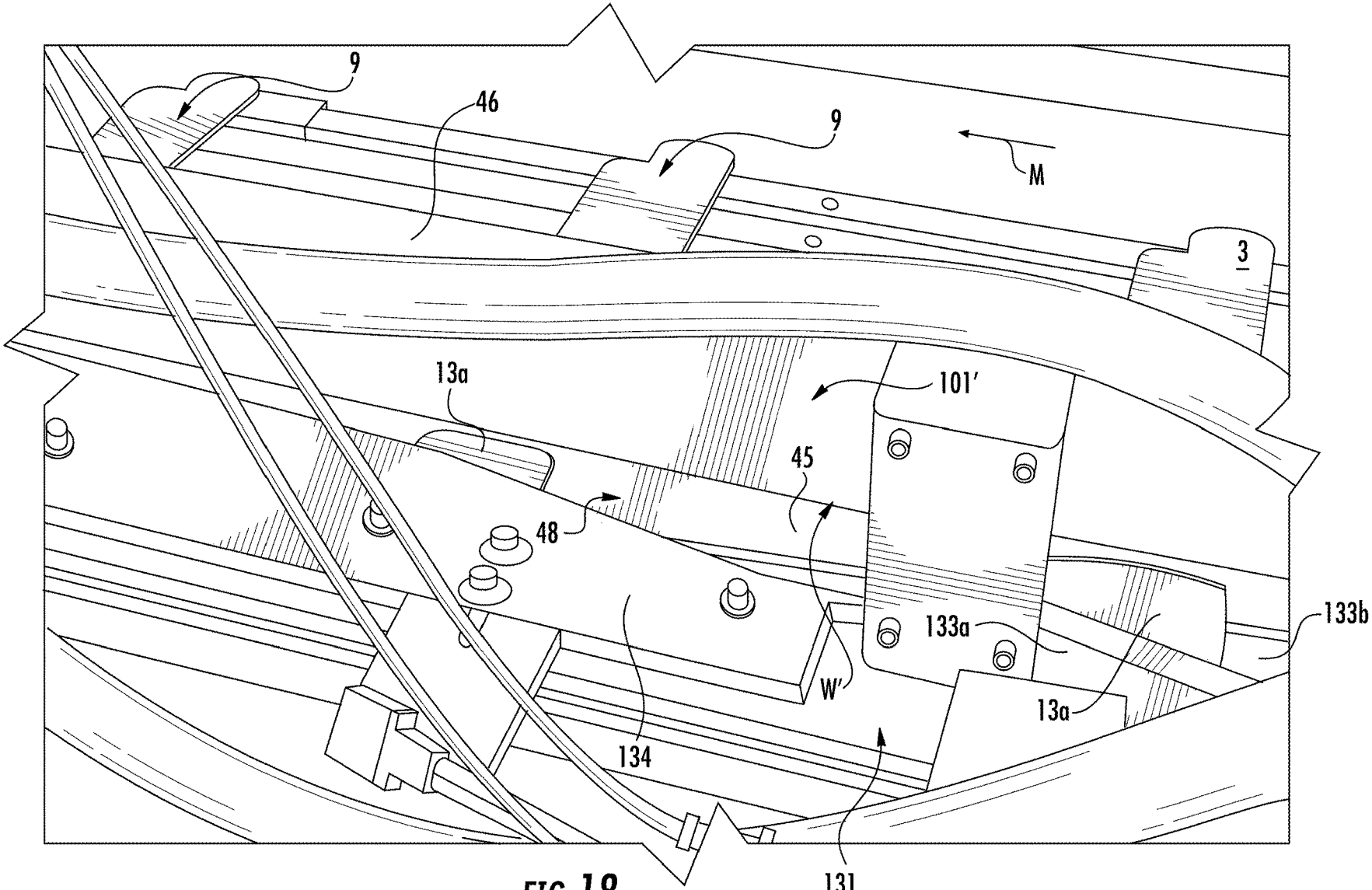

As shown in FIGS. 17 and 18, the adhesive applicator can apply adhesive (e.g., an adhesive 136 shown schematically in FIG. 17) to the construct 3 (e.g., to at least one of the end panels 13*a*, 13*b*, 13*c*) so that one or more of the end panels 13*a*, 13*b*, 13*c* can be overlapped and adhered to at least the bottom portion 45 of the folded web 101' (FIG. 18) to form the construct 3 into the folded construct 9 as the attached web W' moves through the carton forming assembly 131. In the illustrated embodiment, the construct forming assembly 131 can include folding plates including an outer wedge plate 133*a*, an inner guide plate 133*b*, and a forming plate 134. As shown in FIGS. 17 and 18, the inner guide plate 133*b* can extend over the construct 3 (e.g., adjacent and inward of one of the fold lines 11—FIG. 2), and the outer wedge plate 133*a* can push one or more of the end panels 13*a*, 13*b*, 13*c* upwardly to extend generally vertically between the outer wedge plate 133*a* and the inner guide plate 133*b*, folding the construct 3 at least one of the fold lines 11 in one embodiment. As shown in FIGS. 17 and 18, the forming plate 134 can have an inner edge that is angled inwardly to further fold the end panel(s) 13*a*, 13*b*, 13*c* downwardly over the folded web 101'. Additionally, the forming plates 134 can press the end panels against the folded web so that the adhesive 136 can attach the end panel(s) to the tube. The construct forming assembly 131 could be omitted or could be otherwise configured without departing from the disclosure. For example, the construct forming assembly 131 could use forming belts instead of or in addition to the folding plates shown in FIGS. 17 and 18. Alternatively, the construct 3 could be left unfolded in the package 7 by the system 100 and could be folded later (e.g., by another process and system and/or by a user wrapping a food item F in the package 7).

Figure 19:
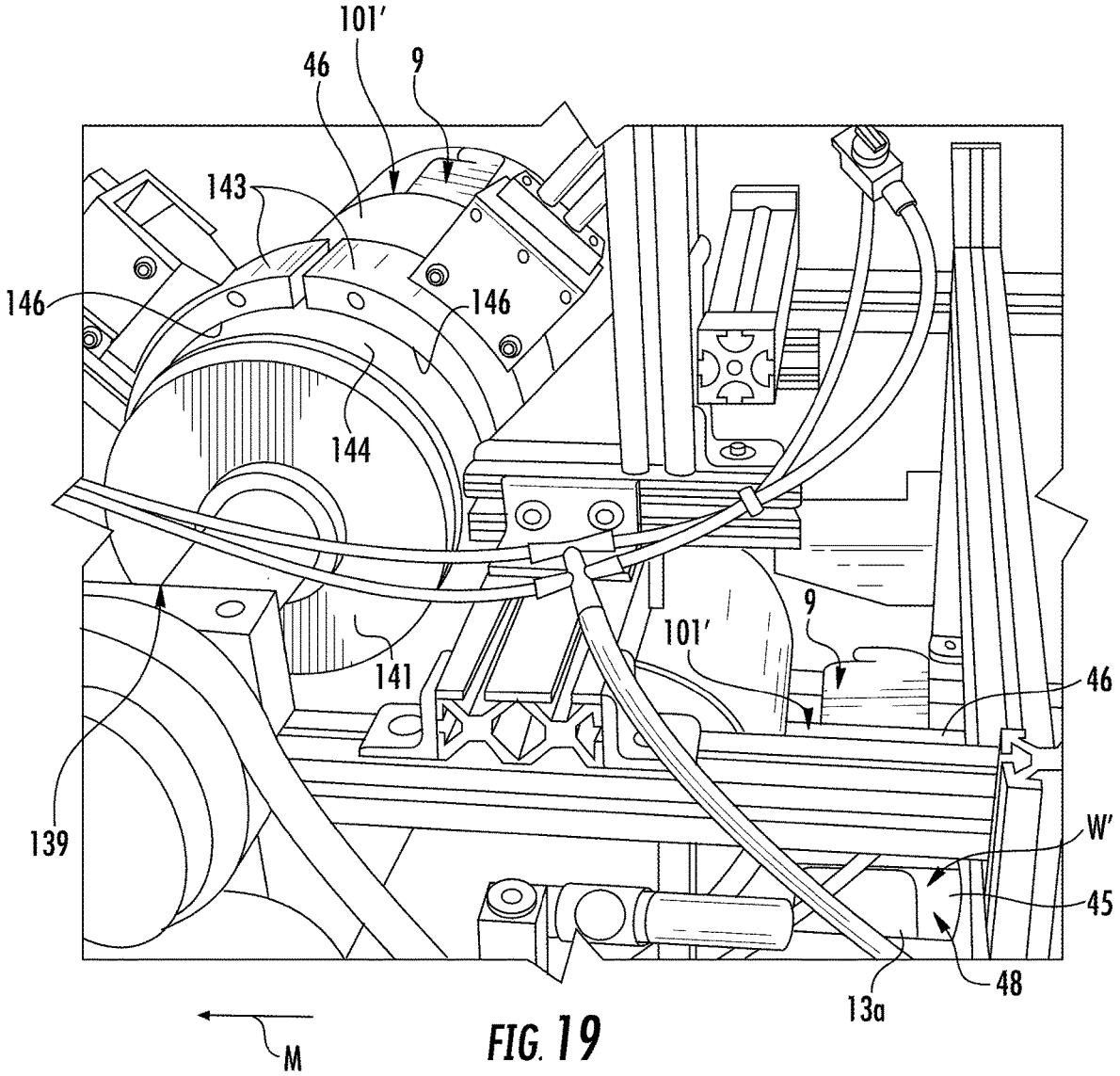
FIG. 19 is a perspective view of a heat sealer assembly of the system of FIG. 5 schematically showing the heat sealer assembly sealing at least a portion of the folded web according to the exemplary embodiment of the disclosure.

As shown in FIGS. 8 and 19, the attached web W' moves from the carton forming assembly 131 through two drive rollers 136, 137 and into a rotary heat sealer assembly 139 that is downstream from the drive rollers. In one embodiment, the attached web W' moves upward from the drive rollers 136, 137 to the rotary heat sealer assembly 139 that includes a heat seal roller 141 and a pair of heat seal arms 143. In one embodiment, the roller 141 generally can have a cylindrical shape with a curved outer surface 144, and the heat seal arms 143 each can have a curved inner surface 146 that is generally complementary with the outer surface 144 of the roller 141. As the attached web W' moves over the roller 141, the heat seal arms 143 can be pressed against the roller 141 so that at least a portion of the attached web W' (e.g., the overlapped bottom portion 45, gusset 52, and main portion 46 of the folded web 101') is pressed between the outer surface 144 and the inner surfaces 146. At least one of the roller 141 and the heat seal arms 143 can be heated in order to activate the heat activated adhesive 104 to bond the overlapped bottom portion 45, gusset 52, and main portion 46 of the folded web 101' and at least partially seal the ends of the pouch 48 at the seal features 54 (e.g., FIGS. 4 and 5). Alternatively, the web of material 101 can comprise a heat sealable material (e.g., a polyethylene laminate or other suitable thermoplastic) in combination with or alternatively to the heat activated adhesive. For example, the heat seal roller 141 can include a pattern of raised features (not shown) on the outer surface 144. The raised features could be arranged and the rotation of the heat seal roller can be timed such that the raised features are generally in registration with the seal features 54 on the folded web 101' as the folded web moves over the heat seal roller and engages the outer surface 144. In this embodiment, the seal features 54 can be pressed between the inner surfaces 146 of the heat seal arms 143 and the raised features on the outer surface 144 of the heat seal roller 141, and heat can be applied to the seal features 54 by the heat seal arms 143 and/or the roller 141. Accordingly, the overlapping layers of the folded web 101' (e.g., portions of the central portion 46, the gusset panels 51, and/or the marginal portion 45) generally can be sealed together where the seal features 54 are in registration with the raised features of the roller 141. In one embodiment, the portions of the folded web 101' that are not in registration with the raised features of the roller 141 generally are not sealed.

The rotary heat sealer assembly 139 could have other components or be otherwise configured. For example, the rotary heat sealer assembly could be similar to the rotary bag sealer assembly disclosed in incorporated-by-reference U.S. Provisional Patent Application No. 62/179,172 and U.S. patent application Ser. No. 15/142,103 and could have a heat seal arm and/or a roller with a square or rectangular cross-sectional shape so that the roller includes four edges or corners around the circumference of the roller that engage the attached web W', with the heat seal arm in contact with the roller to join the layers of overlapped material. Further, the rotary heat sealer assembly 139 could be omitted or could be otherwise shaped, arranged, and/or configured without departing from the disclosure. For example, the pouch 48 could be left unsealed or could be sealed by another system and/or process.

In one embodiment, the system 100 includes scrap cutting assembly 145 (schematically shown in FIG. 8) that trims and shapes the attached web W' to have the desired shape of the liner. For example, the assembly 145 can be a rotary die scrap cutting assembly that includes an upper or cutting roller 147 and a lower roller 149 that cooperate to trim the web material 101 of the attached web W' to remove the scrap portions 56 (e.g., FIG. 3) of the package 7. Alternatively, the cutting assembly 145 could trim one or more portions of the construct 3 or folded construct 9, as needed, or alternative shapes and scrap portions of the web material without departing from the disclosure. The cutting assembly 145 could include other apparatus or methods for cutting and/or trimming the web material 101, and the cutting assembly 145 could be omitted without departing from the disclosure.

As shown in FIG. 9, the system 100 includes a vacuum scrap removal system 150 (schematically shown in FIG. 8) downstream of the scrap cutting assembly 145. The vacuum scrap removal system 150 removes the scrap portions 56 from the attached web W' by a vacuum conveyor that pulls the scrap portions into a removal chute 152. The vacuum scrap removal system 150 could be other than a vacuum system and could be omitted or could be otherwise shaped, arranged, and/or configured without departing from the disclosure.

In one embodiment, the system 100 includes a rotary cutting assembly 151 (schematically shown in FIG. 8) downstream from the rotary heat sealer assembly 139, the scrap cutting assembly 145, and the vacuum scrap removal system 150. The rotary cutting assembly 151 includes a cutting roller 153 and a base roller 155 that cut the attached web W' into the individual packages 7. The attached web W' is cut and separated into individual packages 7 by cutting the folded web 101' at the location corresponding to the side edges of the package 7. The attached web W' can be cut and formed into the packages 7 by other mechanisms without departing from the disclosure. Further, the rotary cutting assembly 151 could be omitted or could be otherwise shaped, arranged, and/or configured without departing from the disclosure.

Figure 20:
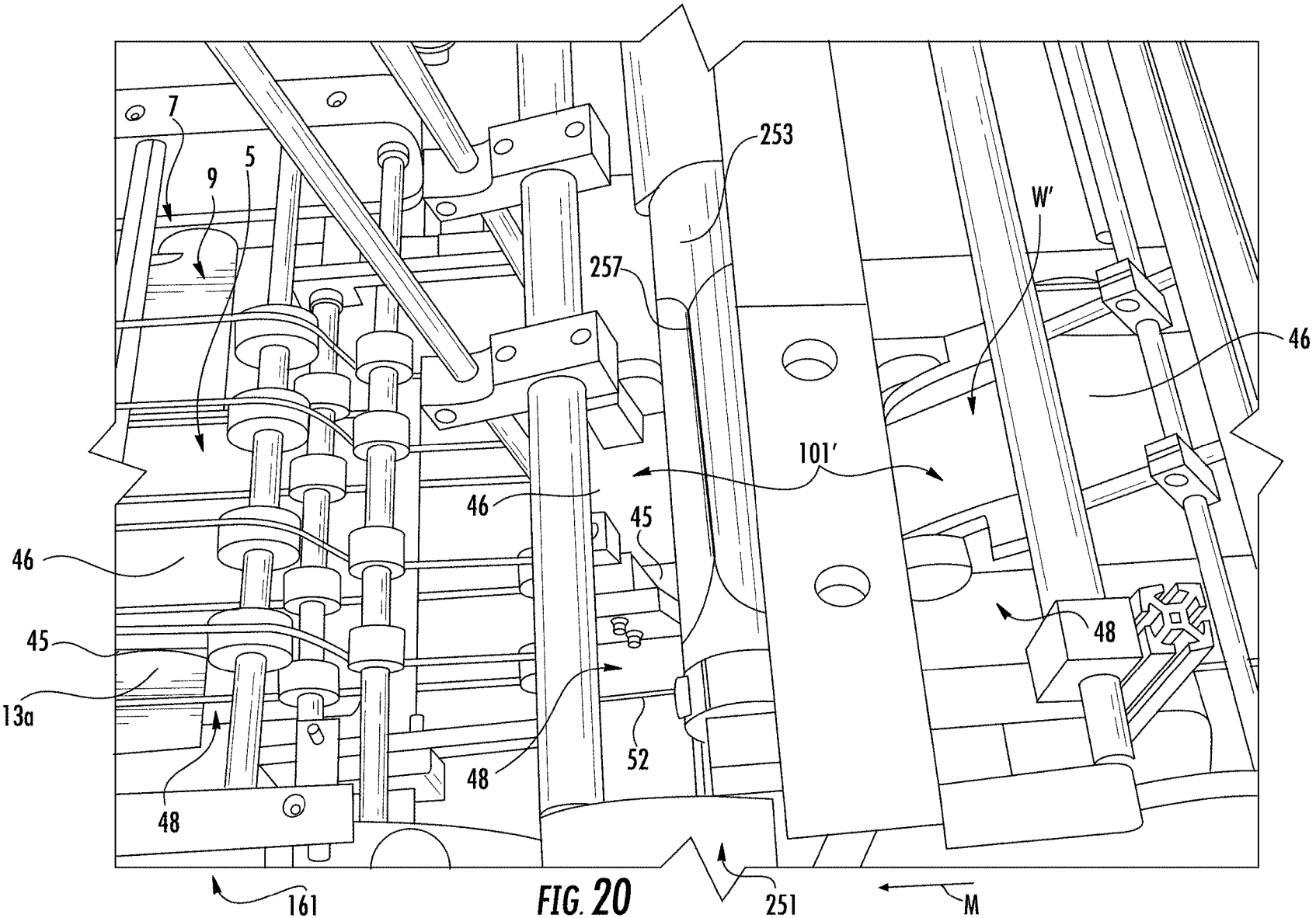
FIGS. 20 and 21 are perspective views of a cutter assembly and a conveyor assembly of the system of FIG. 5 schematically showing the cutting of the attached web into individual reinforced packages according to the exemplary embodiment of the disclosure.
Figure 21:
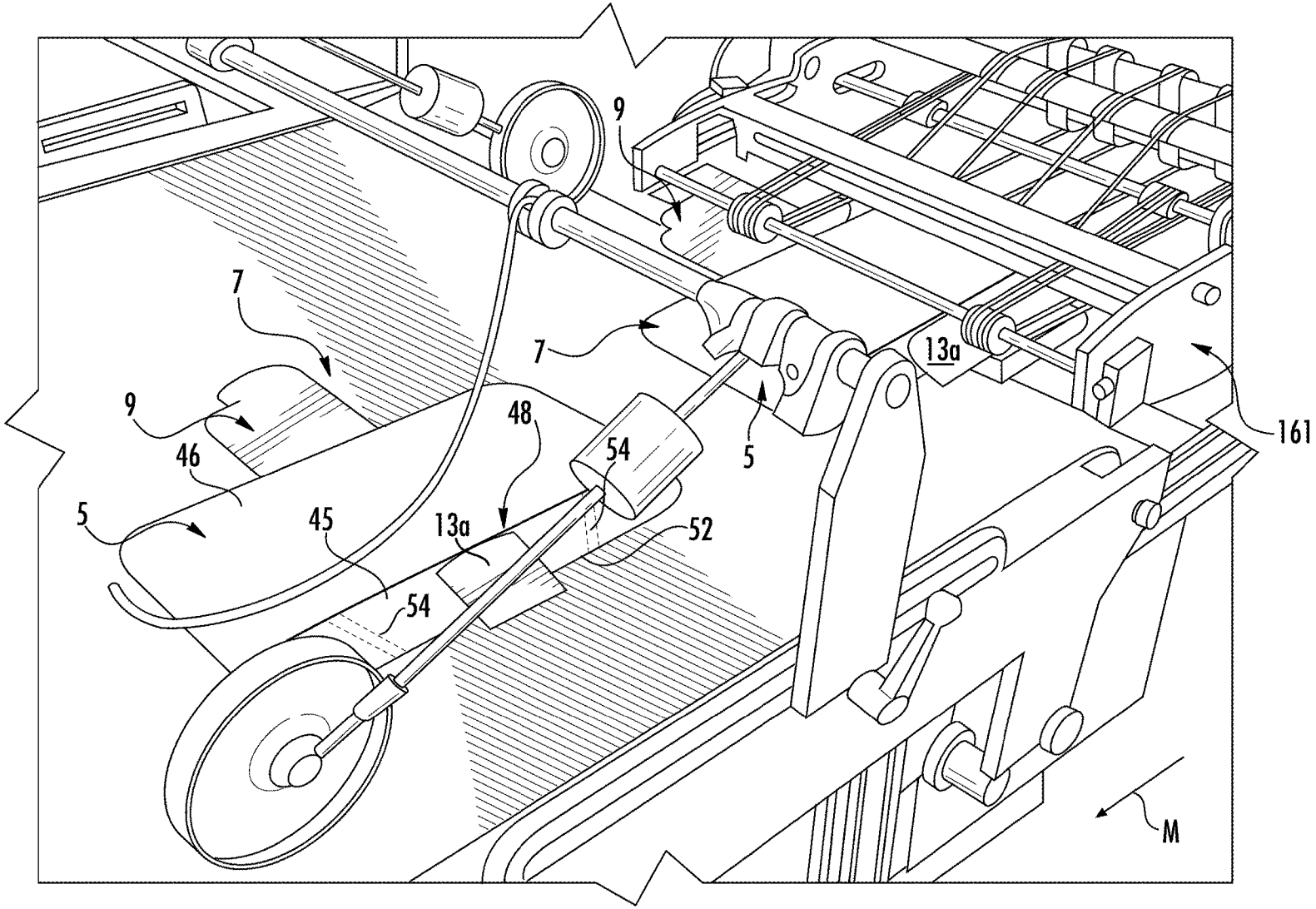

In one embodiment, as shown in FIG. 20, the scrap cutting assembly 145 and the rotary cutting assembly 151 can be combined in a cutting assembly 251. As shown in FIG. 20, the cutting assembly 251 can include a cutting roller 253 with a cutting edge 257 that can both remove the scrap portions 56 of the folded web 101' and separate the liner 5 of a package 7 from the remainder of the folded web W'. A vacuum conveyor or other system could be disposed under or adjacent the rotary cutting assembly 251 to dispose of the scrap portions 56. The rotary cutting assembly 251 could be omitted or could be otherwise shaped, arranged, and/or configured without departing from the disclosure.

In one embodiment, a conveyor assembly 161 is located downstream of the rotary cutting assembly 151 (FIG. 8) or 251 (FIGS. 20 and 21) at the downstream end 105 of the system 100 to transport the separate packages 7 for collection and further handling and/or packaging for shipping to a customer. Other collection, conveying, or discharge mechanisms can be included in the system 100 without departing from this disclosure. In one embodiment, a user can add a food item F to the package 7 and wrap the package around the food item as described above after the package is output from the system and method 100 (e.g., after the package 7 is shipped to the customer).

The system 100 for forming the reinforced packages 7 of the present disclosure form the packages in a highly efficient manner by first attaching the web 101 to the blanks 3 to form the attached web W', and then forming the folded web 101' from the web 101 including the bottom gusset 52. In one embodiment, the blank 3 is then folded during or after forming the folded web 101' and bottom gusset 52 to form the folded construct 9. Alternatively, the construct 3 is not folded by the system 100. The attached web W' including the folded web 101' and the construct 3 or the folded construct 9 is then further processed to form the sealed features 54 and the pouch 48 of the folded web 101' and to cut and separate the liner 5 with the construct 3 or the folded construct 9 attached thereto from the remainder of the attached web W' to form the individual reinforced packages 7. The system 100 of the present disclosure is more efficient than other systems that separately form and shape the liners 5 having the pouches 48 and attach the formed liners to the blanks 3 in that once the blanks 3 are attached to the web 101 to create the attached web W' of the system 100 of the present disclosure, the blanks move with the web 101 in an aligned manner and twisting or turning of the blanks during processing is prevented by the secure attachment to the web. Furthermore, alignment of the separate blanks 3 and the cut and formed liners 5 is no longer needed as the packages 7 formed by the system 100 are formed from the attached web W' including the blanks 3 attached to the web 101.

Generally, as described herein, liners can be formed from a paper stock material, although various plastic or other liner materials also can be used, and can be lined or coated with a desired material. The constructs, blanks, and/or reinforcing sleeves described herein can be made from a more rigid material such as a clay-coated natural kraft ("CCNK"). Other materials such various card-stock, paper, plastic or other synthetic or natural materials also can be used to form the components of the packages described herein.

In general, the blanks of the present disclosure may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A system for forming reinforced packages, the system comprising:

an attachment assembly receiving a web of material and a construct, the attachment assembly bringing the construct into engagement with the web of material for forming an attached web, a web edge forming assembly disposed downstream from the attachment assembly, the web edge forming assembly receiving the attached web and comprising web folding features for folding at least a portion of the web of material to at least partially form a folded web;

a carton forming assembly comprising construct folding features for folding at least a portion of the construct over at least a portion of the folded web; and a cutting assembly downstream from the web edge forming assembly and the carton forming assembly, the cutting assembly comprising cutting features for separating a liner from a remainder of the folded web to at least partially form a reinforced package comprising the liner attached to the construct.

2. The system of claim 1, wherein the carton forming assembly is disposed downstream from the attachment assembly.

3. The system of claim 1, wherein the carton forming assembly receives the attached web from the web edge forming assembly.

4. The system of claim 1, further comprising a sealer assembly for forming at least one seal feature in the folded web, the sealer assembly comprising a heat seal roller and a heat seal arm, the heat seal roller rotating relative to the heat seal arm.

5. The system of claim 4, wherein the heat seal roller is generally cylindrical, and the heat seal arm comprises a curved surface disposed proximate the heat seal roller so that at least a portion of the folded web is pressed between at least a portion of the heat seal arm and at least a portion of the outer surface of the heat seal roller as the heat seal roller is rotated.

6. The system of claim 1, further comprising a blank conveyor for moving the construct to the attachment assembly, the blank conveyor comprising at least one lug belt with at least one lug for engaging the construct and moving the construct toward the attachment assembly.

7. The system of claim 6, further comprising an adhesive applicator, wherein the blank conveyor is for moving the construct at least partially through the adhesive applicator and the attachment assembly, and the attachment assembly comprises at least one nip roller, the adhesive applicator being for applying adhesive to the construct and the at least one nip roller being for pressing the construct with the adhesive against the web of material as the blank conveyor moves the construct through the adhesive applicator and the attachment assembly.

8. The system of claim 1, wherein web forming features of the web edge forming assembly comprise at least one guide roller and an inner forming plate at least partially extending over a central portion of the web of material, the at least one guide roller being for guiding a marginal portion of the web of material over the inner forming plate to at least partially form the folded web.

9. The system of claim 8, wherein the web edge forming assembly further comprises a forming wheel disposed upstream from the at least one guide roller and the inner forming plate, the forming wheel being for at least partially engaging the central portion of the web of material during at least a portion of the folding the marginal portion of the web of material.

10. The system of claim 1, wherein the carton forming assembly comprises an adhesive applicator for applying carton adhesive to at least an end panel of the construct and folding plates for folding at least the end panel relative to a remainder of the construct and positioning at least the end panel against the folded web.

11. The system of claim 1, wherein the cutting assembly comprises a cutting roller for cutting the folded web.

12. The system of claim 1, wherein the construct comprises a paperboard blank and the web of material comprises a flexible sheet of material.

13. The system of claim 1, wherein the construct and the web of material comprise different materials.

* * * * *